US008001938B2

(12) United States Patent
Kameda et al.

(10) Patent No.: US 8,001,938 B2
(45) Date of Patent: Aug. 23, 2011

(54) VALVE CONTROL APPARATUS FOR ENGINE

(75) Inventors: Michihiro Kameda, Kanagawa (JP); Hiroshi Aino, Kanagawa (JP)

(73) Assignee: Nittan Valve Co., Ltd., Kanagawa (JP)

( * ) Notice: Subject to any disclaimer, the term of this patent is extended or adjusted under 35 U.S.C. 154(b) by 281 days.

(21) Appl. No.: 12/442,512

(22) PCT Filed: Sep. 29, 2006

(86) PCT No.: PCT/JP2006/319489

§ 371 (c)(1),
(2), (4) Date: Mar. 23, 2009

(87) PCT Pub. No.: WO2008/041282

PCT Pub. Date: Apr. 10, 2008

(65) Prior Publication Data

US 2010/0024754 A1 Feb. 4, 2010

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

| | | | |
|---|---|---|---|
| 4,862,843 | A | 9/1989 | Kawamoto et al. |
| 2005/0045127 | A1 | 3/2005 | Aino et al. |

FOREIGN PATENT DOCUMENTS

| | | | |
|---|---|---|---|
| JP | 1-134012 | A | 5/1989 |
| JP | 10-153104 | A | 6/1998 |
| JP | 2003-239708 | A | 8/2003 |

OTHER PUBLICATIONS

International Search Report for PCT/JP2006/319489 mailed Dec. 19, 2006.

*Primary Examiner* — Zelalem Eshete
(74) *Attorney, Agent, or Firm* — Roberts Mlotkowski Safran & Cole, P.C.; Thomas W. Cole

(57) ABSTRACT

After having determined a phase angle, the phase angle is maintained as the determined one without consuming electric power.

An intermediate member 14 is movably disposed on the outer periphery of an inner cylinder part 12 that is relatively rotatably disposed with respect to an outer cylinder part 10 to which a driving force of a crankshaft is transmitted and that is connected to a camshaft. In a process in which the intermediate member 14 moves in the axial direction when a solenoid 74 or a solenoid 76 is energized, balls 46 and 48 move in mutually opposite directions in response to a displacement in the axial direction caused by the movement of the intermediate member 14, and the phase between the outer cylinder part 10 and the camshaft 2 is variably adjusted. After the intermediate member 14 is set at an advance position or a retard position when the solenoids 74 and 76 are deenergized, the balls 46 and 48 stop moving for the input of torque from the outer cylinder part 10 or from the camshaft 2, and a self-locking state is reached.

6 Claims, 19 Drawing Sheets

VALVE CONTROL APPARATUS FOR ENGINE

TECHNICAL FIELD

This invention relates to a valve control apparatus for an engine that controls the opening/closing timing of an intake or exhaust valve of the engine while varying the rotational phase of a camshaft that opens and closes the intake valve or the exhaust valve.

BACKGROUND ART

For example, a phase varying apparatus has been proposed as an apparatus for controlling the opening/closing timing of an intake valve of an engine or an exhaust valve thereof. This phase varying apparatus has a structure in which a sprocket to which the driving force of a crankshaft of the engine is transmitted and a camshaft that is a component of a valve operating mechanism are rotated together. Although the sprocket and the camshaft are rotated in synchronization with each other, rotational delay occurs in a rotational drum relative to the sprocket when a braking force acts on the rotational drum by use of an electromagnetic brake means. The phase of the camshaft relative to the sprocket is varied in conjunction with the rotational delay of the rotational drum (see Patent Literature 1). This phase varying apparatus employs a structure in which engine oil is introduced into a relative sliding portion between a friction material of a clutch case and the rotational drum through an oil passage formed in the camshaft, an oil sump provided on the radially inner side of the clutch case, and an oil-introducing notch formed in a front edge part of the inner peripheral wall of the clutch case. Therefore, relative sliding surfaces of the friction material and the rotational drum can be cooled.

[Patent Literature 1] Japanese Published Unexamined Patent Application No. 2002-371814 (see pages 4 to 6, FIG. 1 to FIG. 4.)

DISCLOSURE OF INVENTION

Problems to be Solved by the Invention

In the phase varying apparatus disclosed by Patent Literature 1, when the phase of the camshaft relative to the sprocket body is varied, the braking force must be exerted on the rotational drum by driving an electromagnetic clutch against the elastic force of a torsion coil spring (return spring) at positions other than the initial position of a phase angle. When the phase angle is varied and even after having varied the phase angle (i.e., even after having determined the phase angle), electric power for driving the electromagnetic clutch is always consumed. Moreover, to move an intermediate member in the axial direction of the camshaft in accordance with the braking force acting on the rotational drum, a phase-angle converting mechanism is employed in which a helical spline is formed in the intermediate member, and a helical spline to be engaged with the helical spline of the intermediate member is formed in the sprocket body, and a helical spline to be engaged with the helical spline of the intermediate member is formed in an inner cylinder, so that the movement distance in the axial direction of the intermediate member is converted into a phase angle. Therefore, the phase-angle converting mechanism becomes complex, thus leading to an increase in cost.

The present invention has been made in consideration of the problems of the prior art apparatus. It is therefore an object of the present invention to determine a phase angle and maintain this phase angle without consuming electric power after having determined the phase angle.

Means for Solving the Problems

To solve the problem, a valve control apparatus for an engine according to a first aspect of the present invention comprises an outer cylinder part to which a driving force of a crankshaft of the engine is transmitted; an inner cylinder part that is relatively rotatably disposed on an inner peripheral side of the outer cylinder part and that is coaxially connected to a camshaft by which an intake valve or an exhaust valve of the engine is opened and closed; an intermediate member disposed on an outer periphery of the inner cylinder part so as to be movable in an axial direction of the inner cylinder part; a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member. In the thus structured valve control apparatus for an engine, the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively. The displacements in the circumferential direction are different in magnitude depending on the position in the axial direction of the intermediate member, and are mutually opposite in direction.

(Operation) The phase adjusting mechanism responds to the displacement in the axial direction from the intermediate member only when the phase between the outer cylinder part and the camshaft is variably adjusted. Thereafter, the phase adjusting mechanism converts this displacement in the axial direction into a displacement in the circumferential direction, and gives displacements in the circumferential direction, which are different in magnitude depending on the position in the axial direction of the intermediate member and which are mutually opposite in direction, to the outer cylinder part and to the inner cylinder part. At times other than this time, i.e., after having determined the phase between the outer cylinder part and the camshaft, torque input from the outer cylinder part or from the camshaft is blocked from being transmitted. Therefore, even if torque is input from the outer cylinder part or from the camshaft after having determined the phase between the outer cylinder part and the camshaft, the phase between the outer cylinder part and the camshaft can be maintained as the specified phase without consuming electric power, and electric power consumption can be reduced.

A valve control apparatus for an engine according to a second aspect of the present invention is structured such that, in the valve control apparatus for an engine according to the first aspect of the present invention, the phase adjusting mechanism includes a first lead groove formed on the inner periphery of the outer cylinder part in a direction intersecting with an axial center of the outer cylinder part; a second lead groove formed in an area of the outer periphery of the inner cylinder part, the area facing the first lead groove, the second lead groove extending in a direction intersecting with an axial center of the inner cylinder part and intersecting with the first lead groove; and a plurality of sliding bodies or rolling bodies that are divided into two groups and that are slidably or rollably inserted in sliding passages or rolling passages on the assumption that the first lead groove and the second lead groove are used as the sliding passages or as the rolling passages. In the thus structured valve control apparatus for an engine, the sliding bodies or the rolling bodies belonging to one of the two groups are slidably or rollably placed on the intermediate member, whereas the sliding bodies or the rolling bodies belonging to the other one of the two groups are slidably or rollably placed on a piece; the piece is slidably or rollably inserted in a guide groove formed on a surface of the intermediate member, the surface facing the sliding passage or the rolling passage; an intersection angle between the piece and the guide groove is set to exceed 0 degrees below a friction angle; and the sliding bodies or the rolling bodies belonging to the one of the two groups and the sliding bodies or the rolling bodies belonging to the other one of the two groups move in mutually opposite directions along the sliding passages or the rolling passages in response to a movement of the intermediate member.

(Operation) In a process in which the intermediate member moves to an advance position or a retard position, a sliding body or a rolling body belonging to one of the two groups and a sliding body or a rolling body belonging to the other one of the two groups move in mutually opposite directions along sliding passages or rolling passages in response to a displacement in the axial direction of the intermediate member, and displacements in the circumferential direction, which are different in magnitude depending on the position in the axial direction of the intermediate member and which are mutually opposite in direction, are given to the outer cylinder part and to the inner cylinder part. Therefore, the phase between the outer cylinder part and the camshaft is variably adjusted, On the other hand, when the intermediate member is set at an advance position or a retard position, and when the phase angle between the outer cylinder part and the camshaft is determined, a sliding body or a rolling body belonging to one of the two groups and a sliding body or a rolling body belonging to the other one of the two groups stop moving owing to a frictional force with respect to torque input from the outer cylinder part or from the camshaft, and the torque is blocked from being transmitted. Therefore, the driving-shaft side including the outer cylinder part and the driven-shaft side including the inner cylinder part reach an irreversible state of torque transmission and a self-locking state, and hence the phase between the outer cylinder part and the camshaft can be maintained as the specified phase.

A valve control apparatus for an engine according to a third aspect of the present invention is structured such that, in the valve control apparatus for an engine according to the first aspect of the present invention, the phase adjusting mechanism includes a first lead groove group whose lead grooves are formed on the inner periphery of the outer cylinder in a direction intersecting with the axial center of the outer cylinder part and are formed in parallel with each other; a second lead groove group whose lead grooves are formed in an area of the outer periphery of the inner cylinder part, the area facing the first lead groove group, the second lead groove group extending in a direction intersecting with the axial center of the inner cylinder part and opposite to the direction of the first lead groove group, the lead grooves of the second lead groove group being formed in parallel with each other; a plurality of sliding bodies or rolling bodies slidably or rollably inserted in sliding passages or rolling passages on the assumption that the first lead groove group and the second lead groove group are used as the sliding passages or as the rolling passages; and a piece slidably or rollably inserted in a guide groove formed on a surface of the intermediate member, the surface facing the sliding passage or the rolling passage. In the thus structured valve control apparatus for an engine, the sliding bodies or the rolling bodies are slidably or rollably placed on the intermediate member; the piece receives an elastic force, and is urged in a direction receding from the intermediate member; a movement of the piece caused by the elastic force is restricted by contact with the outer cylinder part or with the inner cylinder part; and an intersection angle between the piece and the guide groove is set to exceed 0 degrees below a friction angle.

(Operation) When a displacement in the axial direction from the intermediate member acts on the phase adjusting mechanism, only the elastic force acts on the piece, and hence the piece slides along the guide groove, and the intermediate member moves in the axial direction of the inner cylinder part. In response to the movement of the intermediate member and the sliding body or the intermediate member and the rolling body, displacements in the circumferential direction, which are different in magnitude depending on the position in the axial direction of the intermediate member and which are mutually opposite in direction, are given to the outer cylinder part and to the inner cylinder part. The outer cylinder part and the inner cylinder part rotate in mutually opposite directions with respect to the sliding body or the rolling body, and the phase between the outer cylinder part and the camshaft is adjusted to the advance side or to the retard side. If torque input from the outer cylinder part or from the camshaft acts between the outer cylinder part and the inner cylinder part and hence is applied in the advance direction or the retard direction when the intermediate member is set at an advance position or a retard position and when the phase angle between the outer cylinder part and the camshaft is in a determined state, the piece is locked in the guide groove of the intermediate member owing to a frictional force, and is blocked from moving. At this time, the outer cylinder part and the inner cylinder part cannot relatively move with respect to the intermediate member, and hence even if torque acts between the outer cylinder part and the inner cylinder part, these do not operate, and reach a self-locking state. Therefore, the phase between the outer cylinder part and the camshaft can be maintained as the specified phase.

A valve control apparatus for an engine according to a fourth aspect of the present invention is structured such that, in the valve control apparatus for an engine according to the first aspect of the present invention, the phase adjusting mechanism includes a piece and a spring arranged mutually in series and inserted between the outer cylinder part and the inner cylinder part. In the thus structured valve control apparatus for an engine, either the intermediate member and the outer cylinder part or the intermediate member and the inner cylinder part are engaged with each other with a helical spline; the piece is slidably inserted in a guide groove formed on the intermediate member, and is urged in a direction receding from the intermediate member by receiving an elastic force from the spring installed in the guide groove; a movement of the piece caused by the elastic force of the spring is restricted by contact with the outer cylinder part or with the inner cylinder part; and an intersection angle between the piece and the guide groove is set to exceed 0 degrees below a friction angle.

(Operation) When a displacement in the axial direction from the intermediate member acts on the phase adjusting mechanism, only the elastic force acts on the piece, and hence the piece slides along the guide groove, and the intermediate member moves in the axial direction of the inner cylinder part while being engaged with the outer cylinder part or the inner cylinder part. In response to the movement of the intermediate member and the rolling body, displacements in the circumferential direction, which are different in magnitude depending on the position in the axial direction of the intermediate member and which are mutually opposite indirection, are given to the outer cylinder part and to the inner cylinder part. The outer cylinder part and the inner cylinder part rotate in mutually opposite directions with respect to the intermediate member, and the phase between the outer cylinder part and the camshaft is adjusted to the advance side or to the retard side. If torque input from the outer cylinder part or from the camshaft acts between the outer cylinder part and the inner cylinder part and hence is applied in the advance direction or the retard direction when the intermediate member is set at an advance position or a retard position and when the phase angle between the outer cylinder part and the camshaft is in a determined state, the piece is locked in the guide groove of the intermediate member owing to a frictional force, and is blocked from moving. At this time, the outer cylinder part and the inner cylinder part cannot relatively move with respect to the intermediate member, and hence even if torque acts between the outer cylinder part and the inner cylinder part, these do not operate, and reach a self-locking state. Therefore, the phase between the outer cylinder part and the camshaft can be maintained as the specified phase.

A valve control apparatus for an engine according to a fifth aspect of the present invention is structured such that, in the valve control apparatus for an engine according to any one of the first, second, third, and fourth aspects of the present invention, the position control mechanism includes a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force. In the thus structured valve control apparatus for an engine, each of the rotary drums is provided with a sliding ramp used for sliding, the sliding ramp extending in a circumferential direction of the rotary drum on an inner peripheral side of the rotary drum; and each ramp is engaged with one of a pair of positioning ramps used for positioning, the positioning ramp extending in a circumferential direction of the intermediate member on an outer peripheral side of the intermediate member.

(Operation) To perform advance control, when each rotary drum rotates together with the intermediate member, an electromagnetic force is generated from the electromagnetic clutch by energizing the electromagnetic clutch, and a braking force is given to one of the rotary drums so as to slow down the rotation thereof. As a result, the intermediate member rotates together with the other one of the rotary drums. At this time, the positioning ramp moves along the sliding ramp of the rotary drum, and hence the intermediate member moves toward, for example, the camshaft in the axial direction of the inner cylinder part. Thereafter, when the electromagnetic clutch is deenergized, the other one of the rotary drums rotates again, and the intermediate member stops moving, and, as a result, the intermediate member is positioned at an arbitrary advance position. On the other hand, when the intermediate member is in an advance position, an electromagnetic force is generated from the electromagnetic clutch by energizing the electromagnetic clutch, and a braking force is given to the other one of the rotary drums so as to slow down the rotation thereof. As a result, the intermediate member rotates together with the one of the rotary drums. At this time, the positioning ramp moves along the sliding ramp of the rotary drum, and hence the intermediate member moves in, for example, a direction receding from the camshaft in the axial direction of the inner cylinder part. Thereafter, when the electromagnetic clutch is deenergized, the other one of the rotary drums rotates again, and the intermediate member stops moving, and, as a result, the intermediate member is positioned at an arbitrary retard position. In other words, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

A valve control apparatus for an engine according to a sixth aspect of the present invention is structured such that, in the valve control apparatus for an engine according to any one of the first, second, third, and fourth aspects of the present invention, the position control mechanism includes a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force. In the thus structured valve control apparatus for an engine, a flange part of the intermediate member is inserted between the one of the rotary drums and the other one of the rotary drums; a surface of each rotary drum facing the flange part of the intermediate member is provided with a forward-lead screw part or a backward-lead screw part that guides the intermediate member in the axial direction of the inner cylinder part; the flange part of the intermediate member has a forward-lead screw part or a backward-lead screw part; and the forward-lead screw part of the rotary drum and the forward-lead screw part of the intermediate member are kept in a state of being engaged with each other, or the backward-lead screw part of the rotary drum and the backward-lead screw part of the intermediate member are kept in a state of being engaged with each other.

(Operation) To perform advance control, when each rotary drum rotates together with the intermediate member, an electromagnetic force is generated from the electromagnetic clutch by energizing the electromagnetic clutch, and a braking force is given to one of the rotary drums so as to slow down the rotation thereof. As a result, the intermediate member rotates together with the other one of the rotary drums. At this time, a speed difference occurs between a screw part of the one of the rotary drums, such as the forward-lead screw part, and the forward-lead screw part of the flange part. Both are in a relatively rotatable state, and the one of the rotary drums is in a decelerated state. As a result, the intermediate member relatively moves in, for example, the direction of the camshaft in the axial direction of the inner cylinder part by engagement between the forward-lead screw part of the one of the rotary drums and the forward-lead screw part of the flange part. Thereafter, when the electromagnetic clutch is deenergized, the one of the rotary drums rotates again, and the intermediate member stops moving, and, as a result, the intermediate member is positioned at an arbitrary advance position.

On the other hand, when the intermediate member is in an advance position, an electromagnetic force is generated from the electromagnetic clutch by energizing the electromagnetic clutch, and a braking force is given to the other one of the rotary drums so as to slow down the rotation thereof. As a result, the intermediate member rotates together with the one of the rotary drums. At this time, a speed difference occurs between a screw part of the other one of the rotary drums, such as the backward-lead screw part, and the backward-lead screw part of the flange part. Both are in a relatively rotatable state, and the other one of the rotary drums is in a decelerated state. As a result, the intermediate member relatively moves in, for example, the direction receding from the camshaft in the axial direction of the inner cylinder part by engagement between the backward-lead screw part of the other one of the rotary drums and the backward-lead screw part of the flange part. Thereafter, when the electromagnetic clutch is deenergized, the other one of the rotary drums rotates again, and the intermediate member stops moving, and, as a result, the intermediate member is positioned at an arbitrary retard position. In other words, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

A valve control apparatus for an engine according to a seventh aspect of the present invention is structured such that, in the valve control apparatus for an engine according to any one of the first, second, third, and fourth aspects of the present invention, the position control mechanism includes a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force. In the thus structured valve control apparatus for an engine, a flange part of the intermediate member is inserted between the one of the rotary drums and the other one of the rotary drums; a surface of each rotary drum facing the flange part of the intermediate member is provided with a forward-lead groove or a backward-lead groove that guides the intermediate member in the axial direction of the inner cylinder part; and the flange part of the intermediate member has a sliding body or a rolling body that is placed slidably or rollably and that uses the forward-lead groove or the backward-lead groove as a sliding passage or a rolling passage.

(Operation) To perform advance control, when each rotary drum rotates together with the intermediate member, an electromagnetic force is generated from the electromagnetic clutch by energizing the electromagnetic clutch, and a braking force is given to one of the rotary drums so as to slow down the rotation thereof. As a result, the intermediate member rotates together with the other one of the rotary drums. At this time, a speed difference occurs between the sliding body or the rolling body and a groove, such as the forward-lead groove. Both are in a relatively rotatable state, and the one of the rotary drums is in a decelerated state. As a result, the intermediate member moves in, for example, the direction of the camshaft in the axial direction of the inner cylinder part by allowing the sliding body or the rolling body to slide or roll along the forward-lead groove of the one of the rotary drums. Thereafter, when the electromagnetic clutch is deenergized, the one of the rotary drums rotates again, and the intermediate member stops moving, and, as a result, the intermediate member is positioned at an arbitrary advance position.

On the other hand, when the intermediate member is in an advance position, an electromagnetic force is generated from the electromagnetic clutch by energizing the electromagnetic clutch, and a braking force is given to the other one of the rotary drums so as to slow down the rotation thereof. As a result, the intermediate member rotates together with the one of the rotary drums. At this time, a speed difference occurs between the sliding body or the rolling body and the backward-lead groove. Both are in a relatively rotatable state, and the other one of the rotary drums is in a decelerated state. As a result, the intermediate member relatively moves in, for example, the direction receding from the camshaft in the axial direction of the inner cylinder part by allowing the sliding body or the rolling body to slide or roll along the backward-lead groove of the other one of the rotary drums. Thereafter, when the electromagnetic clutch is deenergized, the other one of the rotary drums rotates again, and the intermediate member stops moving, and, as a result, the intermediate member is positioned at an arbitrary retard position. In other words, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

Effects of the Invention

As is apparent from the above description, with the valve control apparatus for an engine according to the first aspect of the present invention, even if torque is input from the outer cylinder part or from the cam shaft after having determined the phase between the outer cylinder part and the camshaft, the phase between the outer cylinder part and the camshaft can be maintained as the specified phase without consuming electric power, and electric power consumption can be reduced.

With the valve control apparatus for an engine according to the second aspect of the present invention, the phase between the outer cylinder part and the camshaft is variably adjusted in response to the input of torque from the intermediate member, and, when a phase angle between the outer cylinder part and the camshaft is determined, a self-locking state is reached with respect to the input of torque from the outer cylinder part or from the camshaft, and the phase between the outer cylinder part and the camshaft can be maintained as the specified phase.

With the valve control apparatus for an engine according to the third aspect of the present invention, the phase between the outer cylinder part and the camshaft is variably adjusted in response to the input of torque from the intermediate member, and, when a phase angle between the outer cylinder part and the camshaft is determined, a self-locking state is reached with respect to the input of torque from the outer cylinder part or from the camshaft, and the phase between the outer cylinder part and the camshaft can be maintained as the specified phase.

With the valve control apparatus for an engine according to the fourth aspect of the present invention, the phase between the outer cylinder part and the camshaft is variably adjusted in response to the input of torque from the intermediate member, and, when a phase angle between the outer cylinder part and the camshaft is determined, a self-locking state is reached with respect to the input of torque from the outer cylinder part or from the camshaft, and the phase between the outer cylinder part and the camshaft can be maintained as the specified phase.

With the valve control apparatus for an engine according to the fifth aspect of the present invention, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

With the valve control apparatus for an engine according to the sixth aspect of the present invention, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

With the valve control apparatus for an engine according to the seventh aspect of the present invention, the electromagnetic clutch is energized only when the intermediate member is allowed to move to an arbitrary advance position or an arbitrary retard position. At times other than this time, the electromagnetic clutch is deenergized. Therefore, the intermediate member can be set at an arbitrary advance position or an arbitrary retard position, and electric power consumption can be reduced.

BEST MODE FOR CARRYING OUT THE INVENTION

Embodiments of the present invention will be hereinafter described with reference to the attached drawings. FIG. 1 is a longitudinal sectional view of a valve control apparatus for an engine, showing a first embodiment of the present invention. FIG. 2 is a front view of the valve control apparatus showing the first embodiment of the present invention. FIG. 3 is a rear view of an outer cylinder part. FIG. 4 is a sectional view of the outer cylinder part. FIG. 5 is a development view of the outer cylinder part on its inner peripheral side. FIG. 6 is a perspective view of an inner cylinder part. FIG. 7 is a sectional view of the inner cylinder part. FIG. 8 is a rear view of the inner cylinder part. FIG. 9 is a development view of the inner cylinder part on its outer peripheral side. FIG. 10 is a perspective view of an intermediate member. FIG. 11 is a sectional view of the intermediate member. FIG. 12 is a development view of the intermediate member on its outer peripheral side. FIG. 13 is a perspective view of a rotational drum. FIG. 14 is a sectional view of the rotational drum. FIG. 15 is a development view of the rotational drum on its inner peripheral side. FIG. 16 is a perspective view of another rotational drum. FIG. 17 is a sectional view of the other rotational drum. FIG. 18 is a development view of the other rotational drum on its inner peripheral side. FIG. 19 is a development view for explaining the relationship between the intermediate member and a pair of rotational drums. FIG. 20A is a development view for explaining the relationship between six balls and the inner cylinder part, and FIG. 20B is a development view for explaining the relationship between six balls and the outer cylinder part. FIG. 21 is an enlarged view of a main part for explaining the relationship between a piece and the intermediate member. FIG. 22 is an enlarged rear view of the main part for explaining the relationship between the piece and the intermediate member. FIG. 23 is a schematic view for explaining the relationship between the ball and the piece when advance or retard control is not performed. FIG. 24 is a schematic view for explaining the relationship between the ball and the piece when advance or retard control is performed. FIG. 25 is a development view of a main part of a phase adjusting mechanism, showing a second embodiment of the present invention. FIG. 26 is a development view of a main part of a phase adjusting mechanism, showing a third embodiment of the present invention. FIG. 27 is a sectional view of a position control mechanism, showing a fourth embodiment of the present invention. FIG. 28 is a sectional view of a position control mechanism, showing a fifth embodiment of the present invention. FIG. 29 is a longitudinal sectional view of a valve control apparatus for an engine, showing a sixth embodiment of the present invention. FIG. 30 is a longitudinal sectional view of a valve control apparatus for an engine, showing a seventh embodiment of the present invention.

In these drawings, the valve control apparatus for an engine according to the present invention is used in an engine-oil atmosphere in the state of having been mounted on, for example, an automobile engine, and is an apparatus for transmitting the rotation of a crankshaft to a camshaft so as to open and close an intake or exhaust valve in synchronization with the rotation of the crankshaft and for varying the opening/closing timing of the intake valve or the exhaust valve of the engine depending on the operational state, such as a load or the number of revolutions, of the engine. As shown in FIG. 1, this valve control apparatus is made up of an annular outer cylinder part 10 to which the driving force of the crankshaft of the engine is transmitted, an annular inner cylinder part 12 that is disposed on the inner peripheral side of the outer cylinder part 10 so as to be coaxial with the outer cylinder part 10 and be relatively rotatable with respect to the outer cylinder part 10 and that is coaxially connected to the camshaft 2 by which the intake valve or the exhaust valve of the engine is opened and closed, an intermediate member 14 that has an annular shape and that is disposed on the outer periphery of the inner cylinder part 12 so as to be movable in the axial direction of the inner cylinder part 12, a position control mechanism 16 that controls the position in the axial direction of the intermediate member 14 in accordance with the operational state of the engine, and a phase adjusting mechanism 18 that variably adjusts the phase between the outer cylinder part 10 and the camshaft 2 in accordance with the position in the axial direction of intermediate member 14. An end side in the axial direction of the camshaft 2 is fitted to the inner peripheral side of the inner cylinder part 12, and a cam bolt 19 is tightened to the end side in the axial direction of the camshaft 2. The cam bolt 19 is fixed to an end side in the axial direction of the inner cylinder part 12 by means of a bearing 20 and a stopper 21. The bearing 20 and the stopper 21 are fixed to the outer peripheral surface on an end side in the axial direction of the inner cylinder part 12. As shown in FIG. 2, a holder 23 having the shape of a substantially circular plate is rotatably disposed on a flange part 22 formed integrally with an outer ring of the bearing 20. The holder 23 has three projections 23*a* disposed on its outer peripheral side each at a pitch of 120 degrees. Each projection 23*a* is inserted in a concave part of a cover (not shown) fixed to the engine so as to prevent the holder 23 from rotating in the circumferential direction.

As shown in FIG. 3 to FIG. 5, the outer cylinder part 10 has a plurality of sprockets 24 arranged on the outer peripheral side each of which has the shape of a cylindrical body formed on the drive shaft side. When the driving force of the crankshaft of the engine is transmitted to the sprocket 24 through a chain, the sprocket 24 rotates in synchronization with the crankshaft, and transmits a driving force generated by this rotation to the inner cylinder part 12 through the phase adjusting mechanism 18. A semicircular lead groove (ball groove) 26 serving as an element of the phase adjusting mechanism 18 is formed over the whole circumference on the inner peripheral side of the outer cylinder part 10 in a direction intersecting with the axial center. A small-diameter outer cylinder part 28 is disposed next to the outer cylinder part 10 on the outer periphery of the inner cylinder part 12, and is fixed to the outer cylinder part 10 with a bolt 30. The small-diameter outer cylinder part 28 has a sprocket 32 formed on its outer peripheral side, and rotates in synchronization with the crankshaft when the driving force of the crankshaft of the engine is transmitted to the sprocket 32 through a chain.

As shown in FIG. 6 to FIG. 9, the inner cylinder part 12 is formed as a cylindrical body on the side of the camshaft 2. The inner cylinder part 12 has large-diameter parts 34 and 36 formed on the outer peripheral side of the inner cylinder part 12, and has a cam-bolt through-hole 38 and a camshaft-fitted hole 40 formed on the inner peripheral side. The large-diameter part 36 has semicircular lead grooves (ball grooves) 42 and 44 intersecting with each other serving as an element of the phase adjusting mechanism 18 over the whole circumference in the direction intersecting with the axial center. The lead grooves 42 and 44 serve as rolling passages or sliding passages of the balls 46 and 48, respectively, in the same way as the lead groove 26 of the outer cylinder part 10. Three balls 46 are inserted between the lead grooves 42 and 44 and the lead groove 26 on the side of a clamp pulley CP (i.e., on the head side of the cam bolt 19), whereas three balls 48 are inserted therebetween on the side of the head H (i.e., on the side of the camshaft 2) (see FIG. 1). When the intermediate member 14 moves to an advance position or a retard position in the axial direction of the inner cylinder part 12, the balls 46 and 48, each of which is used as a sliding body or a rolling body serving as an element of the phase adjusting mechanism 18, are moved in mutually opposite directions along the lead grooves 42, 44 and the lead groove 26 in response to a displacement in the axial direction from the intermediate member 14 which is caused by the movement of the intermediate member 14.

As shown in FIG. 10 to FIG. 12, the intermediate member 14 is formed as a cylindrical body having a small-diameter part 50 and a large-diameter part 52, and is disposed to be movable toward the large-diameter parts 34 and 36 of the inner cylinder part 12 in the axial direction of the inner cylinder part 12. The small-diameter part 50 of the intermediate member 14 has three guide grooves 54 (each of which is used to guide a piece 82 holding the ball 48) and three fixing holes 56 (each of which is used to fix the ball 46). The large-diameter part 52 has ramps (positioning ramps) 58 and 60 that have mutually different phases in the circumferential direction and that are formed over the whole circumference in convex shapes, respectively. Although all of the guide grooves 54 are twisted in the same direction in FIG. 12, one or two of these may be twisted in the opposite direction so as to cancel a reaction force in the rotational direction. For example, if one of the guide grooves 54 is twisted in the direction opposite to that of the two remaining guide grooves 54, a force (backlash) in the rotational direction generated by the piece 82 moving in the guide groove 54 can be canceled. The ramp 58 is shaped so that the inclination gradually changes every 180 degrees, and, likewise, the ramp 60 is shaped so that the inclination gradually changes every 180 degrees. In this structure, there is a 90-degree shift in phase between the ramp 58 and the ramp 60.

The position control mechanism 16 that controls the position of the intermediate member 14 is made up of annular rotational drums 62 and 64 and electromagnetic clutches 66 and 68. The electromagnetic clutches 66 and 68 have braking plates 70 and 72 and solenoids 74 and 76, respectively. Each of the solenoids 74 and 76 is connected to a control circuit (not shown) that detects the operational state of the engine and that outputs a control signal or the like (see FIG. 1 and FIG. 2).

As shown in FIG. 13 to FIG. 18, the rotational drums 62 and 64 are formed cylindrically, and are disposed on the outer peripheral side of the inner cylinder part 12. When the rotational drums 62 and 64 do not receive a braking force from the braking plates 70 and 72, the rotational drums 62 and 64 can move in the rotational direction, and the outer cylinder part 10 or the stopper 21 prevents the inner cylinder part 12 from moving in the axial direction. As shown in FIG. 13 to FIG. 15, two ramps (ramps for sliding) 78 in which the position in the axial direction gradually changes are formed as concave parts, respectively, each at a pitch of 180 degrees on the inner peripheral side of the rotational drum 62. The ramp 78 is engaged with the ramp 58 of the intermediate member 14. As shown in FIG. 16 to FIG. 18, two ramps (ramps for sliding) 80 in which the position in the axial direction gradually changes are formed as concave parts, respectively, each at a pitch of 180 degrees on the inner peripheral side of the rotational drum 64. The ramp 80 is engaged with the ramp 60 of the intermediate member 14.

On the other hand, the braking plates 70 and 72 are disposed rotatably upon a bolt 71 serving as a fulcrum in such a way as to surround the rotational drums 62 and 64, respectively (see FIG. 2). When the solenoids 74 and 76 are energized, the braking plates 70 and 72 rotate upon the bolt 71, and give a braking force to the rotational drums 62 and 64, respectively, so as to slow down the rotation of the rotational drums 62 and 64. In this case, the solenoid 74 is energized when the advance control is performed, whereas the solenoid 76 is energized when the retard control is performed. The intermediate member 14 can be moved to the advance position or the retard position by energizing the solenoid 74 or the solenoid 76.

More specifically, when the solenoid 74 and the solenoid 76 are in a non-energized state as shown in FIG. 19, the rotational drums 62 and 64 rotate together with the intermediate member 14. For example, when the opening/closing timing of the intake valve is controlled, the intermediate member 14 is in a most retarded position during idling. Thereafter, to perform the advance control, only the solenoid 74 is energized when the rotational drums 62 and 64 rotate together with the intermediate member 14, and a braking force is given from the braking plate 70 to the rotational drum 62, so that the rotation of the rotational drum 62 is slowed down, and, as a result, the intermediate member 14 rotates together with the rotational drum 64. At this time, the intermediate member 14 moves toward the head H (i.e., toward the camshaft 2) in the axial direction of the inner cylinder part 12 because the ramp 58 moves along the ramp 78 of the rotational drum 62. The solenoid 74 is energized, and hence the intermediate member 14 moves to a most advanced position. When the solenoid 74 is brought into a non-energized state at an arbitrary timing in a process in which the intermediate member 14 moves from the most retarded position to the most advanced position, the intermediate member 14 is positioned at an arbitrary advance position.

On the other hand, to perform the retard control when the intermediate member 14 is in the most advanced position, only the solenoid 76 is energized when the rotational drums 62 and 64 rotate together with the intermediate member 14, and a braking force is given from the braking plate 72 to the rotational drum 64, so that the rotation of the rotational drum 64 is slowed down, and, as a result, the intermediate member 14 rotates together with the rotational drum 62. At this time, the intermediate member 14 moves toward a crank pulley CP (i.e., toward the head of the cam bolt 19) in the axial direction of the inner cylinder part 12 because the ramp 60 moves along the ramp 80 of the rotational drum 64. The solenoid 76 is energized, and hence the intermediate member 14 moves to the most retarded position. When the solenoid 76 is deenergized at an arbitrary timing in a process in which the intermediate member 14 moves from the most advanced position to the most retarded position, the intermediate member 14 is positioned at an arbitrary retard position.

When the intermediate member 14 is in an arbitrary advance position or an arbitrary retard position, the intermediate member 14 rotates together with the rotational drums 62 and 64. Thereafter, when the advance control is performed, the intermediate member 14 can be positioned at another advance position by energizing the solenoid 74, whereas, when the retard control is performed, the intermediate member 14 can be positioned at another retard position by energizing the solenoid 76.

Herein, for example, when the intermediate member 14 is in the most retarded position, the three balls 46 are located on the side of the crank pulley CP (i.e., on the side of the head of the cam bolt 19) in the state of being fixed to the fixing holes 56, respectively, of the intermediate member 14 as shown in FIG. 20A and FIG. 20B, whereas the three balls 48 are located on the side of the head H (i.e., on the side of the camshaft 2) in the state of being held by the pieces 82, respectively, of FIG. 21 and FIG. 22. If the lead groove 26 is represented as six lead grooves 26*a* to 26*f*, and if the lead groove 42 is represented as three lead grooves 42*a*, 42*c*, and 42*e*, and if the lead groove 44 is represented as three lead grooves 44*b*, 44*d*, and 44*f*, the lead grooves 42*a*, 42*c*, and 42*e* correspond to the lead grooves 26*a*, 26*c*, and 26*e*, respectively, whereas the lead grooves 44*b*, 44*d*, and 44*f* correspond to the lead grooves 26*b*, 26*d*, and 26*f*, respectively.

Let it be supposed that the advance control is performed on the assumption that the axial direction of the inner cylinder part 12 and the axial direction of the outer cylinder part 10 are designated as X and X, respectively, and that a state in which the inner cylinder part 12 rotates in the direction of arrow Y and in which the outer cylinder part 10 rotates in the direction of arrow Z is designated as an advanced state. If so, the three balls 46 also move up to the position shown by the broken line from the side of the crank pulley CP toward the head H along the lead grooves 26*b* and 44*b*, the lead grooves 26*d* and 44*d*, and the lead grooves 26*f* and 44*f* in response to the movement of the intermediate member 14 toward the head H. In contrast, the three balls 48 held by the pieces 82 move up to the position shown by the broken line from the side of the head H toward the crank pulley CP along the lead grooves 26*a* and 42*a*, the lead grooves 26*c* and 42*c*, and the lead grooves 26*e* and 42*e*. At this time, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively, in response to the movement of the intermediate member 14 and the movement of the balls 46 and 48. The outer cylinder part 10 rotates counterclockwise when viewed from the side of the crank pulley CP with respect to the balls 46 and 48, whereas the inner cylinder part 12 rotates clockwise when viewed from the side of the crank pulley CP with respect to the balls 46 and 48, so that the phase between the outer cylinder part 10 and the camshaft 2 is adjusted to the advance side.

On the other hand, when the intermediate member 14 is in the advance position shown by the broken line, the three balls 46 fixed to the fixing holes 56 of the intermediate member 14 are closer to the side of the head H (i.e., the side of the camshaft 2) than when the intermediate member 14 is in the most retarded position, whereas the three balls 48 held by the pieces 82 are closer to the side of the crank pulley CP (i.e., the side of the head of the cam bolt 19) than when the intermediate member 14 is in the most retarded position. The retard control is performed from this state, and, in response to the movement of the intermediate member 14 from the side of the head H toward the crank pulley CP, the three balls 46 also move from the side of the head H toward the crank pulley CP, whereas the three balls 48 held by the pieces 82 move from the side of the crank pulley CP toward the head H side. At this time, in response to the movement of the intermediate member 14 and the movement of the balls 46 and 48, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively. Accordingly, the outer cylinder part 10 rotates clockwise when viewed from the side of the crank pulley CP with respect to the balls 46 and 48, whereas the inner cylinder part 12 rotates counterclockwise when viewed from the side of the crank pulley CP with respect to the balls 46 and 48, so that the phase between the outer cylinder part 10 and the camshaft 2 is adjusted to the retard side.

Herein, the three balls 46 are fixed to the intermediate member 14 in the state of being inserted in the holes 56 of the intermediate member 14, and hence move together with the intermediate member 14. On the other hand, the three balls 48 are inserted in the grooves 84 of the pieces 82 inserted in the guide grooves 54 of the intermediate member 14, and hence move together with the pieces 82. As shown in FIG. 21 and FIG. 22, the guide groove 54 of the intermediate member 14 is inclined relative to the axial center of the intermediate member 14, and a straight-line part 86 of the groove 84 of the piece 82 is inclined relative to the axial direction of the intermediate member 14. An extension line of the guide groove 54 of the intermediate member 14 and the extension line of the straight-line part 86 of the piece 82 intersect with each other at an intersection angle θ that is set to have an angle exceeding 0 degrees below a friction angle.

Therefore, even if torque is input from the outer cylinder part 10 or from the camshaft 2 when the advance control or the retard control is not performed in a state in which the intermediate member 14 is in an arbitrary advance position or an arbitrary retard position, this torque input allows the ball 48 placed in the piece 82 inserted in the guide groove 54 inclined relative to the axial center L of the camshaft 2 (i.e., relative to the axial center parallel to the axial center of the intermediate member 14) to generate a force F perpendicular to the straight-line part 86 of the piece 82 as shown in FIG. 23. A force Fa parallel to the force F is generated as a reaction force relative to the intermediate member 14 of the piece 82. At this time, if the force F is resolved into an element Fa parallel to the force F and an element Fb perpendicular to the guide groove 54, an angle (θ1-(−θ2)) between the element Fa parallel to the force F and the element Fb perpendicular to the guide groove 54 becomes equal to an intersection angle θ between the extension line of the guide groove 54 and the extension line of the straight line part 86 of the piece 82 (θ=θ1-(−θ2)). From the assumption concerning the intersection angle θ mentioned above, a frictional force Fc acting on the guide groove 54 is the same as an element Fd parallel to the guide groove 54 of the force F, and hence the piece 82 cannot be moved. As a result, the ball 48 cannot also be moved, and is kept stationary, and hence the intermediate member 14 remains in the arbitrary advance position or the arbitrary retard position.

On the other hand, if the intermediate member 14 is displaced in the axial direction when the advance control or the retard control is performed in a state in which the intermediate member 14 is in an arbitrary advance position or an arbitrary retard position, this displacement in the axial direction acts on the piece 82 as a force F lowering the piece 82 downwardly as shown in FIG. 24. At this time, as a result of the movement of the piece 82 (i.e., the movement in the direction of arrow B), the straight-line part 86 of the piece 82 induces the ball 48 to move in a direction (i.e., direction of arrow C) opposite to the direction in which the intermediate member 14 moves. As a result, the intermediate member 14 is positioned at the arbitrary advance position or the arbitrary retard position by performing the advance control or the retard control.

According to this embodiment, in a process in which the intermediate member 14 moves to the advance position or the retard position when the solenoid 74 or the solenoid 76 is energized, the balls 46 and 48 move in the mutually opposite directions in response to the displacement in the axial direction resulting from the movement of the intermediate member 14, and displacements in the circumferential directions, which are displacements in the circumferential directions opposite to each other and which differ in magnitude depending on the position in the axial direction of the intermediate member 14, are given to the outer cylinder part 10 and the inner cylinder part 12, respectively, so that the phase between the outer cylinder part 10 and the camshaft 2 is variably adjusted.

On the other hand, if the intermediate member 14 is set at the advance position or the retard position, and the phase angle between the outer cylinder part 10 and the camshaft 2 is determined when the solenoid 74 and the solenoid 76 are deenergized, the balls 46 and 48 stop moving when torque is input from the outer cylinder part 10 or the camshaft 2, and the torque input is blocked from being transmitted. Therefore, the driving-shaft side including the outer cylinder part 10 and the driven-shaft side including the inner cylinder part 12 reach an irreversible state of torque transmission and a self-locking state.

In other words, after the phase angle between the outer cylinder part 10 and the camshaft 2 is determined, the driving-shaft side including the outer cylinder part 10 and the driven-shaft side including the inner cylinder part 12 reach a self-locking state without consuming electric power even if a reaction force is received from the camshaft 2. Therefore, the phase angle can be maintained as the determined one, and electric power consumption can be reduced.

Additionally, the intermediate member 14 is not required to be moved against the elastic force of a return spring, and can be moved merely by energizing the solenoid 74 or the solenoid 76. Therefore, electric power consumption can be made lower than in a structure using a return spring.

Additionally, when the ramps 58 and 60 are formed on the intermediate member 14, these ramps 58 and 60 are shaped so as to become mutually different in phase in the circumferential direction. Therefore, in this embodiment, the length in the axial direction of the entire intermediate member 14 can be made shorter, and the length in the axial direction of the entire apparatus can be made shorter than in an example in which the ramps are shaped to become mutually equal in phase in the circumferential direction.

Next, a second embodiment of the present invention will be described with reference to FIG. 25. In this embodiment, lead grooves, each of which is used as a sliding passage for balls or a rolling passage for balls, have a parallel groove structure. Element arrangements other than this are the same as in the first embodiment. More specifically, a phase adjusting mechanism 18A serves as an irreversible torque transmission mechanism, and is composed of a first lead groove group (ball groove group) 90 whose grooves are twisted in a direction intersecting with the axial center of the outer cylinder part 10 on the inner periphery of the outer cylinder part 10 and whose grooves are parallel to each other; a second lead groove group (ball groove group) 92 whose grooves intersect with the axial center of the inner cylinder part 12 in an area facing the first lead groove group of the outer periphery of the inner cylinder part 12, whose grooves are twisted in a direction opposite to that of the first lead groove group 90, and whose grooves are parallel to each other; six balls 46 inserted so as to be slidable or rollable in sliding or rolling passages that are the grooves of the first lead groove group 90 and the grooves of the second lead groove group 92; and pieces 94 slidably or rollably inserted in guide grooves 54 formed in a surface, which faces the sliding or rolling passages, of the intermediate member 14.

The first lead groove group 90 is composed of six lead grooves 90*a* to 90*f* parallel to each other. The second lead groove group 92 is composed of six lead grooves 92*a* to 92*f* that are parallel to each other and that are twisted in a direction opposite to that of the lead grooves 90*a* to 90*f*. The grooves of both groups are formed as parallel grooves.

Each ball 46 serving as a sliding body or a rolling body is slidably or rollably placed in the fixing hole 56 of the intermediate member 14. Each piece 94 having a substantially rectangular shape is slidably inserted in the guide groove 54, and is urged in a direction receding from the intermediate member 14 by receiving an elastic force from a spring 96 installed in the guide groove 54. The movement of each piece 94 caused by the elastic force of the spring 96 is restricted by contact with the outer cylinder part 10 or with the inner cylinder part 12. An intersection angle θ between the piece 94 and the guide groove 54 (i.e. an angle θ between a straight line along the guide groove 54 and the axial center of the intermediate member 14) is set to exceed 0 degrees below a friction angle.

The phase adjusting mechanism 18A serves as an irreversible torque transmission mechanism, and, when torque acts between the outer cylinder part 10 and the inner cylinder part 12, these cylinder parts 10 and 12 are twisted in mutually opposite directions, However, a relative movement occurs between the intermediate member 14 and the outer cylinder part 10 or between the intermediate member 14 and the inner cylinder part 12, and, as a result, the intermediate member 14 starts moving in its axial direction, whereas the outer cylinder part 10 and the inner cylinder part 12 start moving in the rotational direction. At this time, the intermediate member 14 is ready to rotate together with the outer cylinder part 10 or the inner cylinder part 12 owing to the friction of the piece 94 against the outer cylinder part 10 or the inner cylinder part 12. However, the intermediate member 14 is ready to be moved in the axial direction opposite to the direction in which torque is applied (i.e., direction in which torque acts) by being brought and rotated by the piece 94.

For example, if torque is input from the outer cylinder part 10 or from the camshaft 2, then acts between the outer cylinder part 10 and the inner cylinder part 12, and hence is applied in the advance direction (i.e., if the intermediate member 14 proceeds toward the head H) in a state in which the solenoid 74 and the solenoid 76 are in a non-energized state, in which the intermediate member 14 is set at an advance position or a retard position, and in which a phase angle between the outer cylinder part 10 and the camshaft 2 is determined, the piece 94 is locked in the guide groove 54 of the intermediate member 14 owing to a frictional force, so that it becomes impossible for the intermediate member 14 to proceed toward the head H. At this time, the outer cylinder part 10 and the inner cylinder part 12 cannot relatively move with respect to the intermediate member 14, and hence do not operate, and reach a self-locking state even if torque acts between the outer cylinder part 10 and the inner cylinder part 12.

On the other hand, if a displacement in the axial direction of the intermediate member 14 acts on the phase adjusting mechanism 18A, only the elastic force of the spring 96 acts on the piece 94, and hence the piece 94 is slid along the guide groove 54, and the intermediate member 14 can move in the axial direction of the inner cylinder part 12.

Herein, for example, if the advance control is performed by energizing the solenoid 74 when the intermediate member 14 is in the retard position, the ball 46 fixed to the intermediate member 14 also moves toward the head H together with the intermediate member 14 in response to the movement of the intermediate member 14 toward the head H. At this time, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively, in response to the movement of the intermediate member 14 and the movement of the ball 46. The outer cylinder part 10 rotates counterclockwise when viewed from the side of the crank pulley CP with respect to the ball 46, whereas the inner cylinder part 12 rotates clockwise when viewed from the side of the crank pulley CP with respect to the ball 46, so that the phase between the outer cylinder part 10 and the camshaft 2 is adjusted to the advance side.

On the other hand, if the retard control is performed by energizing the solenoid 76 when the intermediate member 14 is in the advance position, the ball 46 fixed to the intermediate member 14 also moves from the side of the head H toward the crank pulley CP in response to the movement of the intermediate member 14 from the side of the head H toward the crank pulley CP. At this time, in response to the movement of the intermediate member 14 and the movement of the ball 46, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively. Accordingly, the outer cylinder part 10 rotates clockwise when viewed from the side of the crank pulley CP with respect to the ball 46, whereas the inner cylinder part 12 rotates counterclockwise when viewed from the side of the crank pulley CP with respect to the ball 46, so that the phase between the outer cylinder part 10 and the camshaft 2 is adjusted to the retard side.

According to this embodiment, in a process in which the intermediate member 14 moves to the advance position or the retard position when the solenoid 74 or the solenoid 76 is energized, the ball 46 moves along the lead groove groups 90 and 92 in response to the displacement in the axial direction resulting from the movement of the intermediate member 14, and displacements in the circumferential directions, which are displacements in the circumferential directions opposite to each other and which differ in magnitude depending on the position in the axial direction of the intermediate member 14, are given to the outer cylinder part 10 and the inner cylinder part 12, respectively, so that the phase between the outer cylinder part 10 and the camshaft 2 is variably adjusted.

On the other hand, if the intermediate member 14 is set at the advance position or the retard position, and the phase angle between the outer cylinder part 10 and the camshaft 2 is determined when the solenoid 74 and the solenoid 76 are deenergized, the ball 46 stops moving when torque is input from the outer cylinder part 10 or the camshaft 2, and the torque input is blocked from being transmitted. Therefore, the driving-shaft side including the outer cylinder part 10 and the driven-shaft side including the inner cylinder part 12 reach an irreversible state of torque transmission and a self-locking state.

In other words, after the phase angle between the outer cylinder part 10 and the camshaft 2 is determined, the driving-shaft side including the outer cylinder part 10 and the driven-shaft side including the inner cylinder part 12 reach a self-locking state without consuming electric power even if a reaction force is received from the camshaft 2. Therefore, the phase angle can be maintained as the determined one, and electric power consumption can be reduced.

Next, a third embodiment of the present invention will be described with reference to FIG. 26. In this embodiment, a helical spline is used instead of balls, and element arrangements other than this are the same as in the first or second embodiment. In a phase adjusting mechanism 18B of this embodiment serving as an irreversible torque transmission mechanism, a piece 94 and a spring 96 are arranged in series and are inserted between the outer cylinder part 10 and the inner cylinder part 12, and a helical spline 98 is formed on the outer peripheral surface of the intermediate member 14. The helical spline 98 of the intermediate member 14 is formed to be engaged with a helical spline (not shown) formed on the outer cylinder part 10.

It is also possible to employ a structure formed such that the position of the outer cylinder part 10 and the position of the inner cylinder part 12 are oppositely arranged and such that a helical spline to be engaged with the helical spline 98 of the intermediate member 14 is formed on the inner cylinder part 12.

Each piece 94 having a substantially rectangular shape is slidably inserted in the guide groove 54, and is urged in a direction receding from the intermediate member 14 by receiving an elastic force from the spring 96 installed in the guide groove 54. The movement of each piece 94 caused by the elastic force of the spring 96 is restricted by contact with the outer cylinder part 10. An intersection angle θ between the piece 94 and the guide groove 54 (i.e., an angle θ between a straight line along the guide groove 54 and the axial center of the intermediate member 14) is set to exceed 0 degrees below a friction angle.

The phase adjusting mechanism 18B serves as an irreversible torque transmission mechanism, and, when torque acts between the outer cylinder part 10 and the inner cylinder part 12, these cylinder parts 10 and 12 are twisted in mutually opposite directions. However, a relative movement occurs between the intermediate member 14 and the outer cylinder part 10 or between the intermediate member 14 and the inner cylinder part 12, and, as a result, the intermediate member 14 starts moving in its axial direction, whereas the outer cylinder part 10 and the inner cylinder part 12 start moving in the rotational direction. At this time, the intermediate member 14 is ready to rotate together with the outer cylinder part 10 or the inner cylinder part 12 owing to the friction of the piece 94 against the outer cylinder part 10 or the inner cylinder part 12. However, the intermediate member 14 is ready to be moved in the axial direction opposite to the direction in which torque is applied (i.e., direction in which torque acts) by being brought and rotated by the piece 94.

For example, if torque is input from the outer cylinder part 10 or from the camshaft 2, then acts between the outer cylinder part 10 and the inner cylinder part 12, and hence is applied in the advance direction (i.e., if the intermediate member 14 proceeds toward the head H) in a state in which the solenoid 74 and the solenoid 76 are in a non-energized state, in which the intermediate member 14 is set at an advance position or a retard position, and in which a phase angle between the outer cylinder part 10 and the camshaft 2 is determined, the piece 94 is locked in the guide groove 54 of the intermediate member 14 owing to a frictional force, so that it becomes impossible for the intermediate member 14 to proceed toward the head H. At this time, the outer cylinder part 10 and the inner cylinder part 12 cannot relatively move with respect to the intermediate member 14, and hence do not operate, and reach a self-locking state even if torque acts between the outer cylinder part 10 and the inner cylinder part 12.

On the other hand, if a displacement in the axial direction of the intermediate member 14 acts on the phase adjusting mechanism 18B, only the elastic force of the spring 96 acts on the piece 94, and hence the piece 94 is slid along the guide groove 54, and the intermediate member 14 can move in the axial direction of the inner cylinder part 12 while the helical spline 98 is being engaged with the helical spline of the outer cylinder part 10.

Herein, for example, if the advance control is performed by energizing the solenoid 74 when the intermediate member 14 is in the retard position, the intermediate member 14 moves toward the head H while the helical spline 98 is being engaged with the helical spline of the outer cylinder part 10. At this time, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively, in response to the movement of the intermediate member 14. The outer cylinder part 10 rotates counterclockwise when viewed from the side of the crank pulley CP with respect to the intermediate member 14, whereas the inner cylinder part 12 rotates clockwise when viewed from the side of the crank pulley CP with respect to the intermediate member 14, so that the phase between the outer cylinder part 10 and the camshaft 2 is adjusted to the advance side.

On the other hand, if the retard control is performed by energizing the solenoid 76 when the intermediate member 14 is in the advance position, the intermediate member 14 moves from the side of the head H toward the crank pulley CP while the helical spline 98 is being engaged with the helical spline of the outer cylinder part 10. At this time, in response to the movement of the intermediate member 14, displacements in the circumferential directions, which are displacements in the circumferential directions opposite to each other and which differ in magnitude from each other depending on the position in the axial direction of the intermediate member 14, are given to the outer cylinder part 10 and the inner cylinder part 12, respectively. Accordingly, the outer cylinder part 10 rotates clockwise when viewed from the side of the crank pulley CP with respect to the intermediate member 14, whereas the inner cylinder part 12 rotates counterclockwise when viewed from the side of the crank pulley CP with respect to the intermediate member 14, so that the phase between the outer cylinder part 10 and the camshaft 2 is adjusted to the retard side.

According to this embodiment, in a process in which the intermediate member 14 moves to the advance position or the retard position when the solenoid 74 or the solenoid 76 is energized, the intermediate member 14 moves in the axial direction of the inner cylinder part 12 while the helical spline 98 is being engaged with the helical spline of the outer cylinder part 10 in response to the displacement in the axial direction resulting from the movement of the intermediate member 14, and displacements in the circumferential directions, which are displacements in the circumferential directions opposite to each other and which differ in magnitude depending on the position in the axial direction of the intermediate member 14, are given to the outer cylinder part 10 and the inner cylinder part 12, respectively, so that the phase between the outer cylinder part 10 and the camshaft 2 is variably adjusted.

On the other hand, if the intermediate member 14 is set at the advance position or the retard position, and the phase angle between the outer cylinder part 10 and the camshaft 2 is determined when the solenoid 74 and the solenoid 76 are deenergized, the intermediate member 14 stops moving when torque is input from the outer cylinder part 10 or the camshaft 2, and the torque input is blocked from being transmitted. Therefore, the driving-shaft side including the outer cylinder part 10 and the driven-shaft side including the inner cylinder part 12 reach an irreversible state of torque transmission and a self-locking state.

In other words, after the phase angle between the outer cylinder part 10 and the camshaft 2 is determined, the driving-shaft side including the outer cylinder part 10 and the driven-shaft side including the inner cylinder part 12 reach a self-locking state without consuming electric power even if a reaction force is received from the camshaft 2. Therefore, the phase angle can be maintained as the determined one, and electric power consumption can be reduced.

Next, a fourth embodiment of the present invention will be described with reference to FIG. 27. In this embodiment, a position control mechanism 16A is structured by using a forward lead screw and a backward lead screw. Element arrangements other than this are the same as in anyone of the first to third embodiments. The position control mechanism 16A of this embodiment includes a plurality of rotational drums 100 and 102 and electromagnetic clutches 66 and 68. The rotational drums 100 and 102 are disposed around the inner cylinder part 12 so as to be rotated together with the inner cylinder part 12. The electromagnetic clutches 66 and 68 give a braking force to the rotational drum 100 and hence slow down the rotation of the rotational drum 100 by energizing the solenoid 74 and by rotating the braking plate 70 when the advance control is performed, whereas the electromagnetic clutches 66 and 68 give a braking force to the rotational drum 102 and hence slow down the rotation of the rotational drum 102 by energizing the solenoid 76 and by rotating the braking plate 72 when the retard control is performed. A flange part 104 of an intermediate member 14A is inserted between the rotational drum 100 and the rotational drum 102 (note that the intermediate member 14A corresponds to a structure formed by providing the flange part 104 on the side of an end in the axial direction of the intermediate member 14). A forward-lead screw part 106 or a backward-lead screw part 108 that guides the intermediate member 14A in the axial direction of the inner cylinder part 12 is formed on a surface, which faces the intermediate member 14A, of each of the rotational drums 100 and 102. The forward-lead screw part 106 is engaged with a forward-lead screw part 112 of the intermediate member 14A, whereas the backward-lead screw part 108 is engaged with a backward-lead screw part 110 of the intermediate member 14A.

Herein, the rotational drums 100 and 102 rotate together with the intermediate member 14A when the solenoid 74 and the solenoid 76 are in a non-energized state. For example, when the opening/closing timing of the intake valve is controlled, the intermediate member 14A is in the most retarded position during idling. Thereafter, to perform the advance control, only the solenoid 74 is energized when the rotational drums 100 and 102 rotate together with the intermediate member 14A, and a braking force is given from the braking plate 70 to the rotational drum 100, so that the rotation of the rotational drum 100 is slowed down. As a result, the intermediate member 14A rotates together with the rotational drum 102. At this time, a speed difference occurs between the screw part 106 and the screw part 112, and hence these two are in the state of being rotated relative to each other, and the rotational drum 100 is in a decelerated state. As a result, the intermediate member 14A relatively moves toward the head H by the engagement between the screw part 106 and the screw part 112. The intermediate member 14A moves to the most advanced position by energizing the solenoid 74. When the solenoid 74 is deenergized at an arbitrary timing in a process in which the intermediate member 14A moves from the most retarded position to the most advanced position, the intermediate member 14A is positioned at an arbitrary advance position.

On the other hand, to perform the retard control when the intermediate member 14A is in the most advanced position, only the solenoid 76 is energized when the rotational drums 100 and 102 rotate together with the intermediate member 14A, and a braking force is given from the braking plate 72 to the rotational drum 102, so that the rotation of the rotational drum 102 is slowed down. As a result, the intermediate member 14A rotates together with the rotational drum 100. At this time, a speed difference occurs between the screw part 108 and the screw part 110, and hence these two are in the state of being rotated relative to each other, and the rotational drum 102 is in a decelerated state. As a result, the intermediate member 14A relatively moves toward the crank pulley CP (i.e., toward the head of the cam bolt 19) in the axial direction of the inner cylinder part 12 by the engagement between the screw part 108 and the screw part 110. The intermediate member 14A moves to the most retarded position by energizing the solenoid 76. When the solenoid 76 is deenergized at an arbitrary timing in a process in which the intermediate member 14A moves from the most advanced position to the most retarded position, the intermediate member 14A is positioned at an arbitrary retard position.

When the intermediate member 14A is in an arbitrary advance position or an arbitrary retard position, the intermediate member 14A rotates together with the rotational drums 100 and 102. Thereafter, when the advance control is performed, the intermediate member 14A can be positioned at another advance position by energizing the solenoid 74. Additionally, when the retard control is performed, the intermediate member 14A can be positioned at another retard position by energizing the solenoid 76.

According to this embodiment, the intermediate member 14A can be accurately positioned at an advance position or a retard position by the engagement between the forward-lead screw parts 106 and 112 and the backward-lead screw parts 108 and 110.

Next, a fifth embodiment of the present invention will be described with reference to FIG. 28. In this embodiment, a position control mechanism 16B is structured by using balls and a backward-lead groove. Element arrangements other than this are the same as in any one of the first to fourth embodiments. The position control mechanism 16B of this embodiment includes a plurality of rotational drums 114 and 116 and electromagnetic clutches 66 and 68. The rotational drums 114 and 116 are disposed around the inner cylinder part 12 so as to be rotated together with the inner cylinder part 12. The electromagnetic clutches 66 and 68 give a braking force to the rotational drum 114 and hence slow down its rotation together with the inner cylinder part 12 by energizing the solenoid 74 and by rotating the braking plate 70 when the advance control is performed, whereas the electromagnetic clutches 66 and 68 give a braking force to the rotational drum 116 and hence slow down its rotation together with the inner cylinder part 12 by energizing the solenoid 76 and by rotating the braking plate 72 when the retard control is performed. A flange part 118 of an intermediate member 14B is inserted between the rotational drum 114 and the rotational drum 116 (note that the intermediate member 14B corresponds to a structure formed by providing the flange part 118 on the side of an end in the axial direction of the intermediate member 14). A forward-lead ball groove (right-hand thread) 122 and a backward-lead ball groove (left-hand thread) 120 both of which guide the intermediate member 14B in the axial direction of the inner cylinder part 12 are formed on a surface, which faces the intermediate member 14B, of each of the rotational drums 114 and 116. Ball grooves 120 and 122 are formed as rolling passages or sliding passages, respectively, for a ball 124 slidably or rollably inserted in a hole of the flange part 118 of the intermediate member 14B.

Herein, the rotational drums 114 and 116 rotate together with the intermediate member 14B when the solenoid 74 and the solenoid 76 are in a non-energized state. For example, when the opening/closing timing of the intake valve is controlled, the intermediate member 14B is in the most retarded position during idling. Thereafter, to perform the advance control, only the solenoid 74 is energized when the rotational drums 114 and 116 rotate together with the intermediate member 14B, and a braking force is given from the braking plate 70 to the rotational drum 114, so that the rotation of the rotational drum 114 is slowed down. As a result, the intermediate member 14B rotates together with the rotational drum 114. At this time, a speed difference occurs between the ball 124 and the ball groove 120, and hence these two are in the state of being rotated relative to each other, and the rotational drum 114 is in a decelerated state. As a result, the intermediate member 14B moves toward the head H by allowing the ball 124 to roll or slide along the ball groove 122. The intermediate member 14B moves to the most advanced position by energizing the solenoid 74. When the solenoid 74 is deenergized at an arbitrary timing in a process in which the intermediate member 14B moves from the most retarded position to the most advanced position, the intermediate member 14B is positioned at an arbitrary advance position.

On the other hand, to perform the retard control when the intermediate member 14B is in the most advanced position, only the solenoid 76 is energized when the rotational drums 114 and 116 rotate together with the intermediate member 14B, and a braking force is given from the braking plate 72 to the rotational drum 116, so that the rotation of the rotational drum 116 is slowed down. As a result, the intermediate member 14B rotates together with the rotational drum 114. At this time, a speed difference occurs between the ball 124 and the ball groove 122, and hence these two are in the state of being rotated relative to each other, and the rotational drum 116 is in a decelerated state. As a result, the intermediate member 14B relatively moves toward the crank pulley CP (i.e., toward the head of the cam bolt 19) in the axial direction of the inner cylinder part 12 by allowing the ball 124 to roll or slide along the ball groove 120. The intermediate member 14B moves to the most retarded position by energizing the solenoid 76. When the solenoid 76 is deenergized at an arbitrary timing in a process in which the intermediate member 14B moves from the most advanced position to the most retarded position, the intermediate member 14B is positioned at an arbitrary retard position.

When the intermediate member 14B is in an arbitrary advance position or an arbitrary retard position, the intermediate member 14B rotates together with the rotational drums 114 and 116. Thereafter, when the advance control is performed, the intermediate member 14B can be positioned at another advance position by energizing the solenoid 74. Additionally, when the retard control is performed, the intermediate member 14B can be positioned at another retard position by energizing the solenoid 76.

According to this embodiment, the intermediate member 14B can be accurately positioned at an advance position or a retard position by allowing the ball 124 to move along the forward-lead ball groove 122 or the backward-lead ball groove 120.

Next, a sixth embodiment of the present invention will be described with reference to FIG. 29. In this embodiment, a flange part 22A in which a mounting part 22*a* is formed at an end in the axial direction of the flange part 22 is used instead of the flange part 22 of the bearing 20. The bearing 20 is disposed between the outer periphery of the intermediate member 14 and the mounting part 22*a*. A holder 23 is mounted on the outer periphery of the intermediate member 14 with the bearing 20 and the flange part 22A therebetween. Element arrangements other than this arrangement are the same as in the first embodiment. The structure of this embodiment can be applied also to those of the second to fifth embodiments.

According to this embodiment, since the holder 23 is mounted on the outer periphery of the intermediate member 14 with the bearing 20 and the flange part 22A therebetween, the length in the axial direction of the inner cylinder part 12 can be made shorter than in the first embodiment.

Next, a seventh embodiment of the present invention will be described with reference to FIG. 30. In this embodiment, a flange part 22B in which a mounting part 22*b* is formed at an end in the axial direction of the flange part 22 is used instead of the flange part 22 of the bearing 20. The bearing 20 is disposed between the flange part 10*a* of the outer cylinder part 10 and the mounting part 22*b*. The holder 23 is mounted on the outer periphery of the flange part 10*a* of the outer cylinder part 10 with the bearing 20 and the flange part 22B therebetween. Element arrangements other than this arrangement are the same as in the first embodiment. The structure of this embodiment can be applied also to those of the second to fifth embodiments.

According to this embodiment, since the holder 23 is mounted on the outer periphery of the flange part 10*a* of the outer cylinder part 10 with the bearing 20 and the flange part 22B therebetween, the length in the axial direction of the inner cylinder part 12 can be made shorter than in the first embodiment.

According to each embodiment mentioned above, the general-purpose solenoids 74 and 76 can be used as the electromagnetic clutches 66 and 68. Therefore, production costs can be reduced.

Additionally, according to each embodiment mentioned above, the entire apparatus has an integrally-formed structure. Therefore, handling can be performed more easily than in a conventional structure in which an electromagnetic clutch is mounted on a cover side.

DESCRIPTION OF SIGNS

Figure 1:
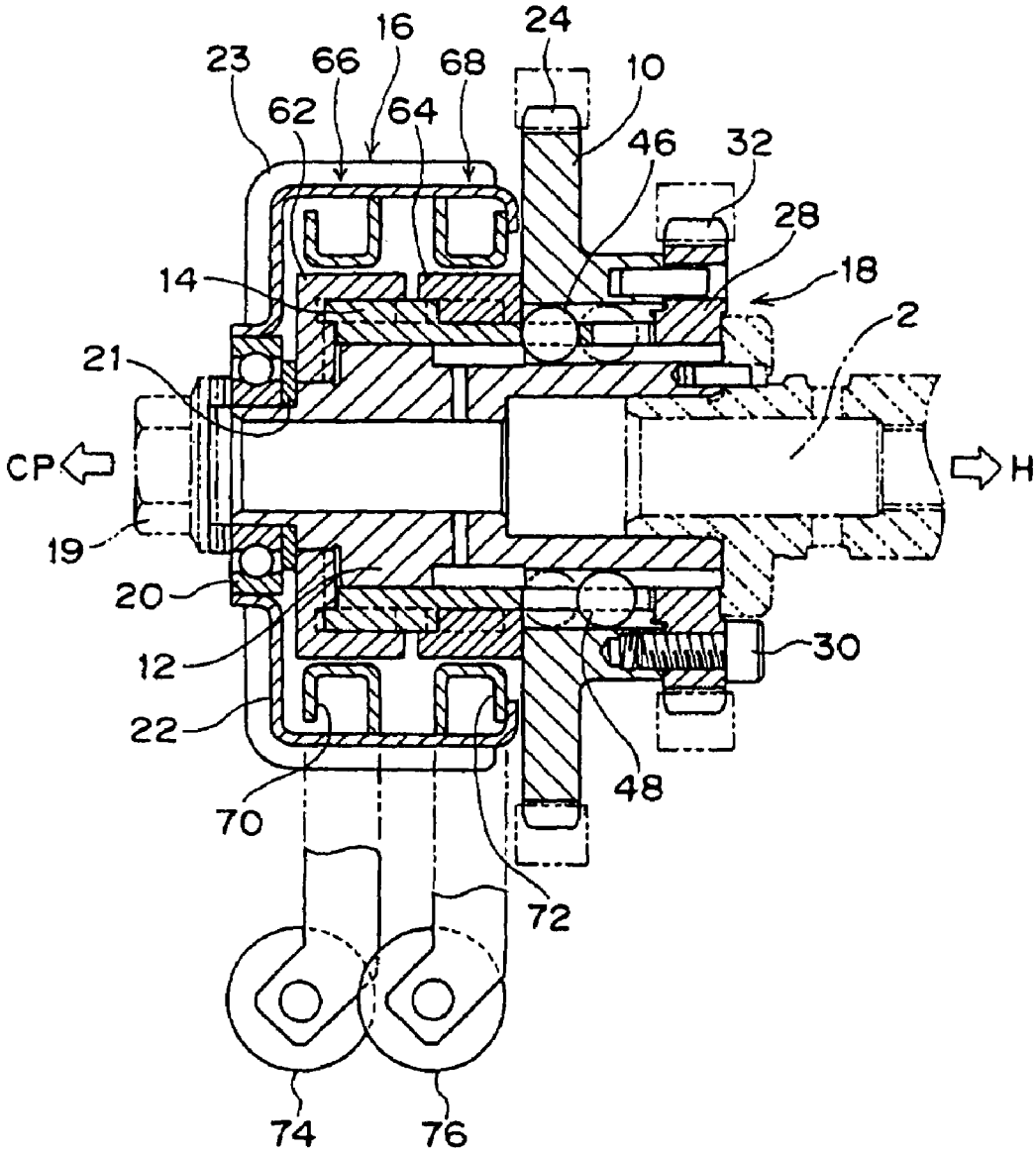
FIG. 1 is a longitudinal sectional view of a valve control apparatus for an engine, showing a first embodiment of the present invention.
Figure 2:
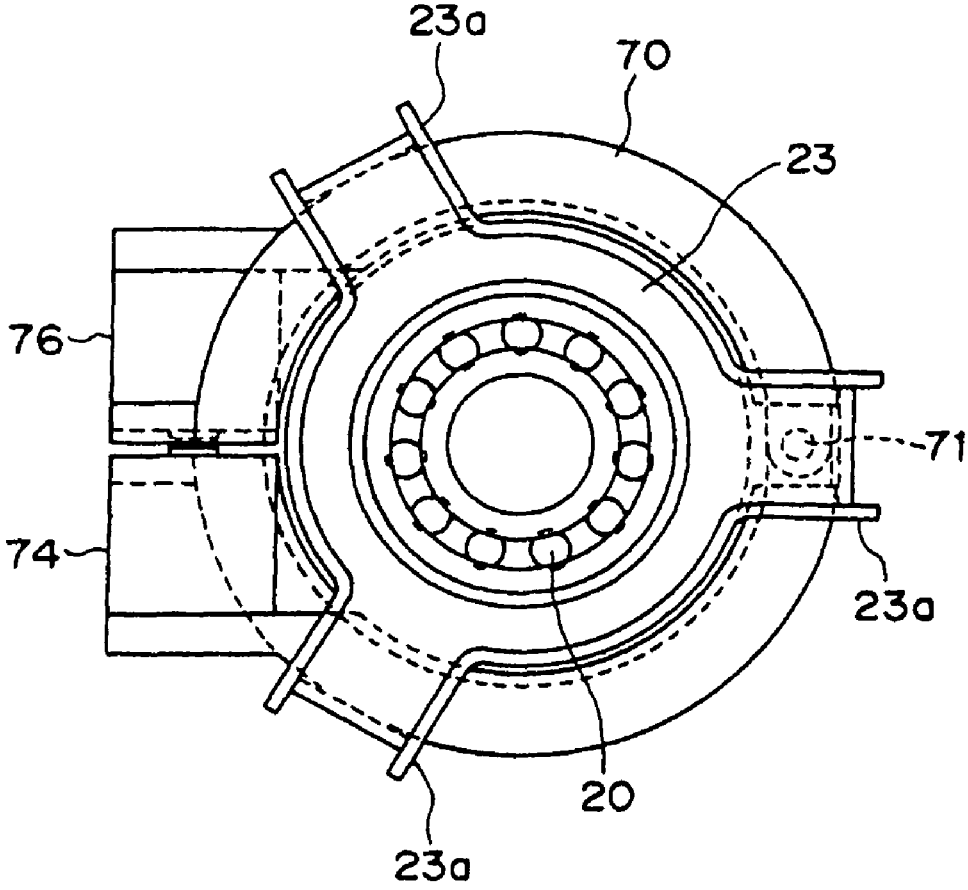
FIG. 2 is a front view of the valve control apparatus showing the first embodiment of the present invention.
Figure 3:
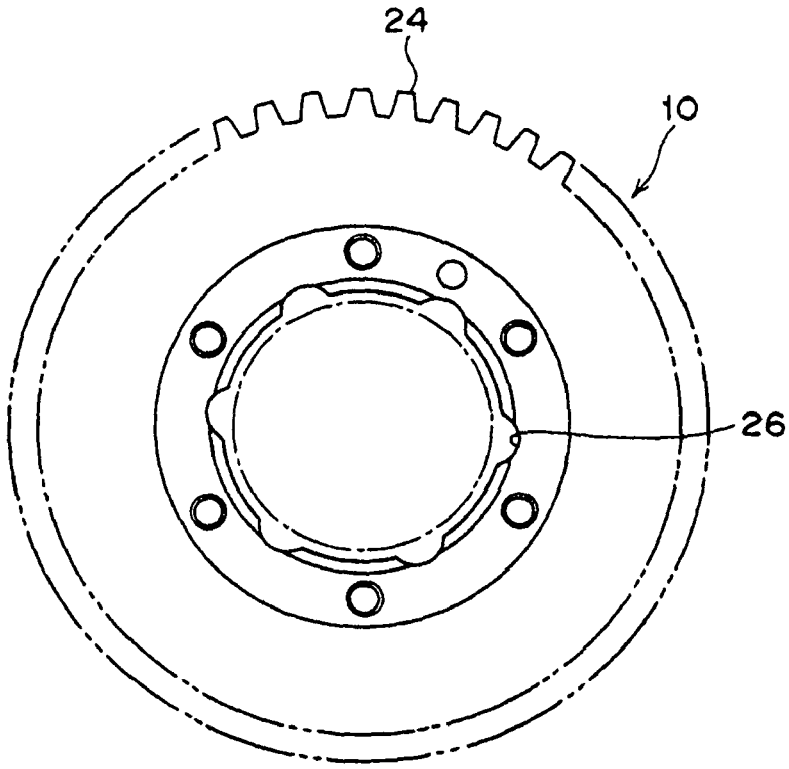
FIG. 3 is a rear view of an outer cylinder part.
Figure 4:
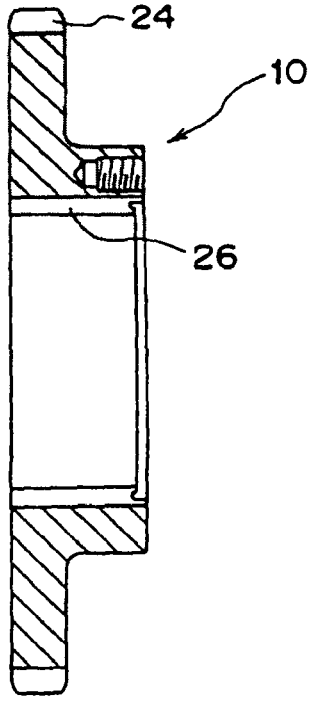
FIG. 4 is a sectional view of the outer cylinder part.
Figure 5:
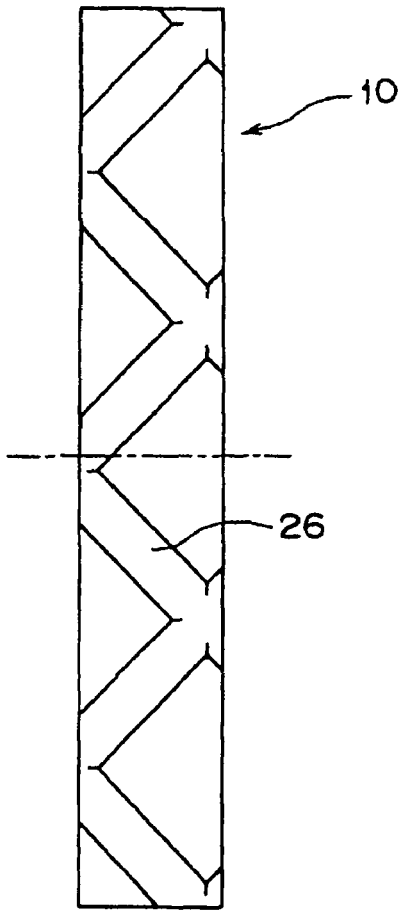
FIG. 5 is a development view of the outer cylinder part on its inner peripheral side.
Figure 6:
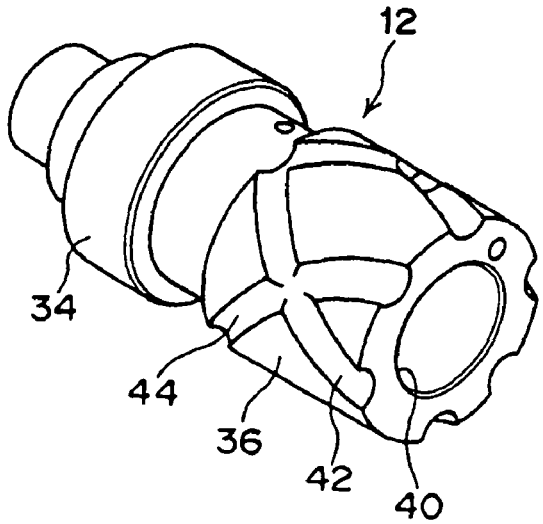
FIG. 6 is a perspective view of an inner cylinder part.
Figure 7:
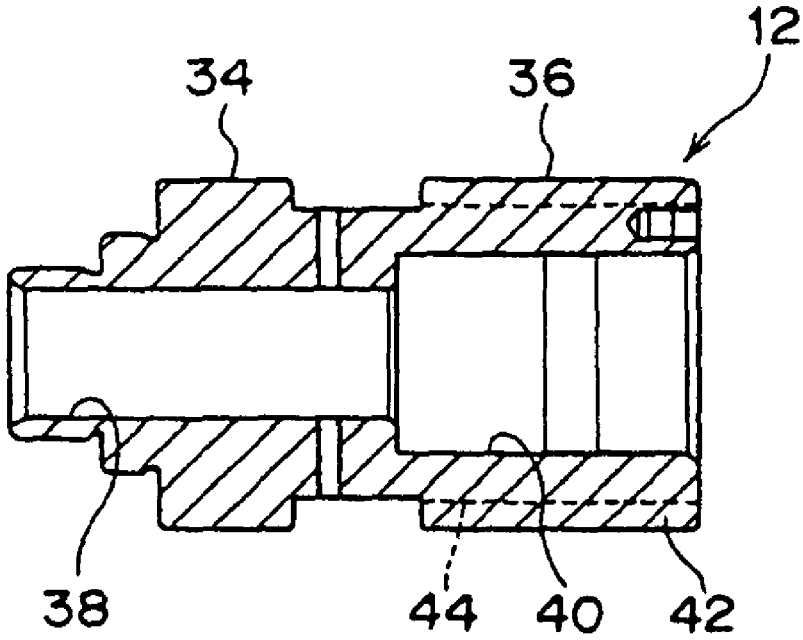
FIG. 7 is a sectional view of the inner cylinder part.
Figure 8:
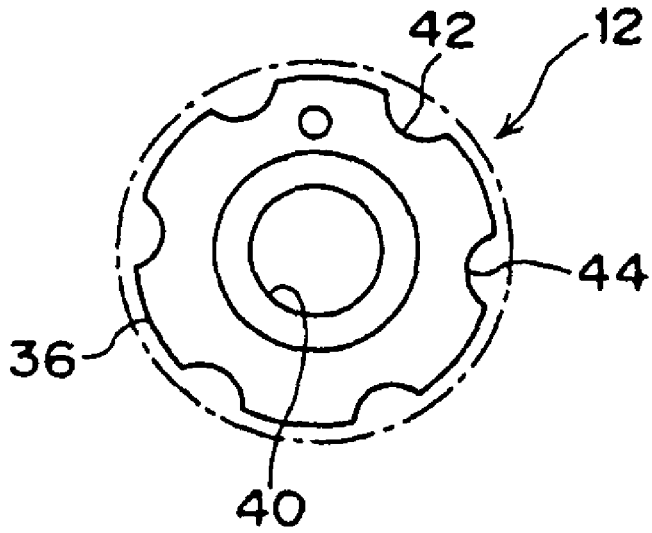
FIG. 8 is a rear view of the inner cylinder part.
Figure 9:
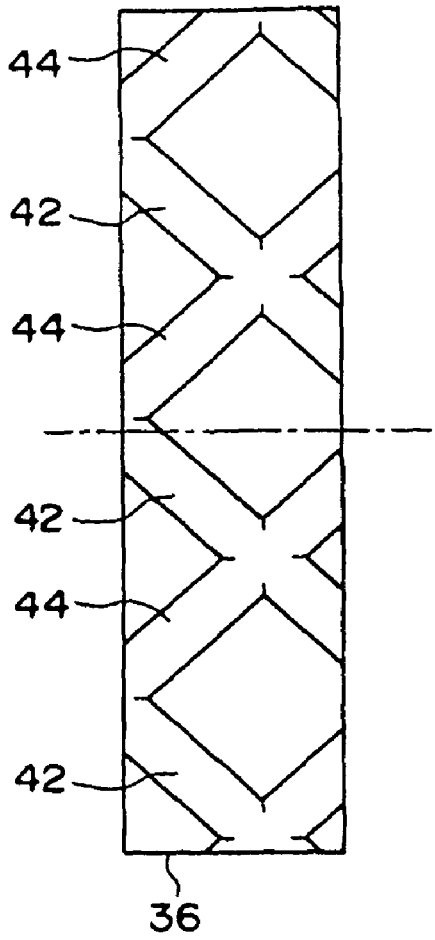
FIG. 9 is a development view of the inner cylinder part on its outer peripheral side.
Figure 10:
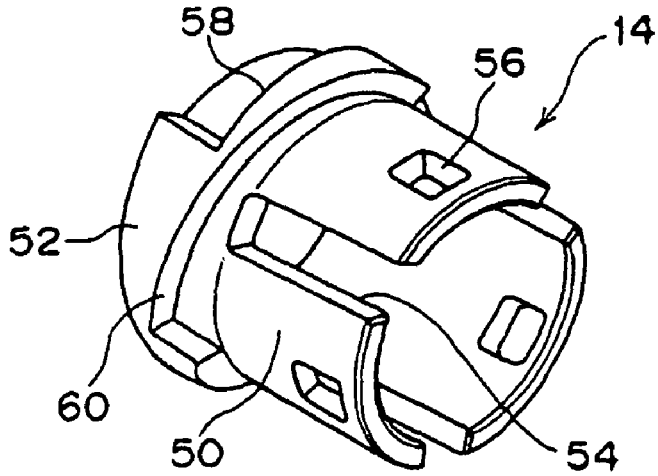
FIG. 10 is a perspective view of an intermediate member.
Figure 11:
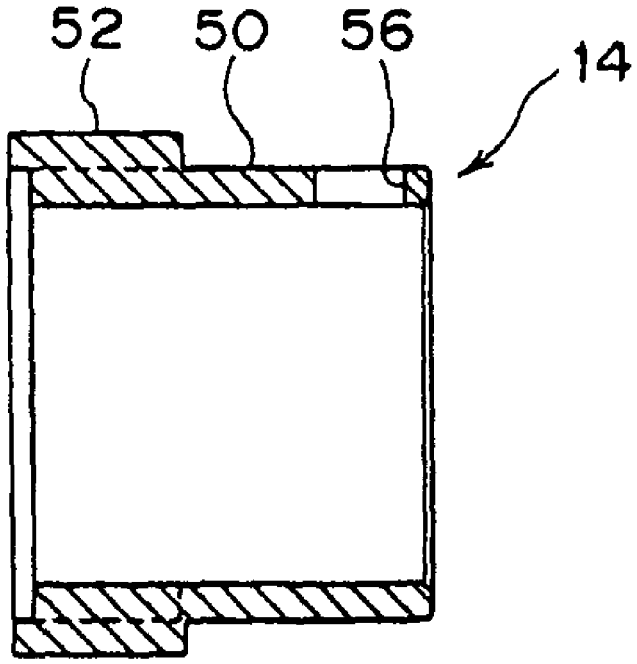
FIG. 11 is a sectional view of the intermediate member.
Figure 12:
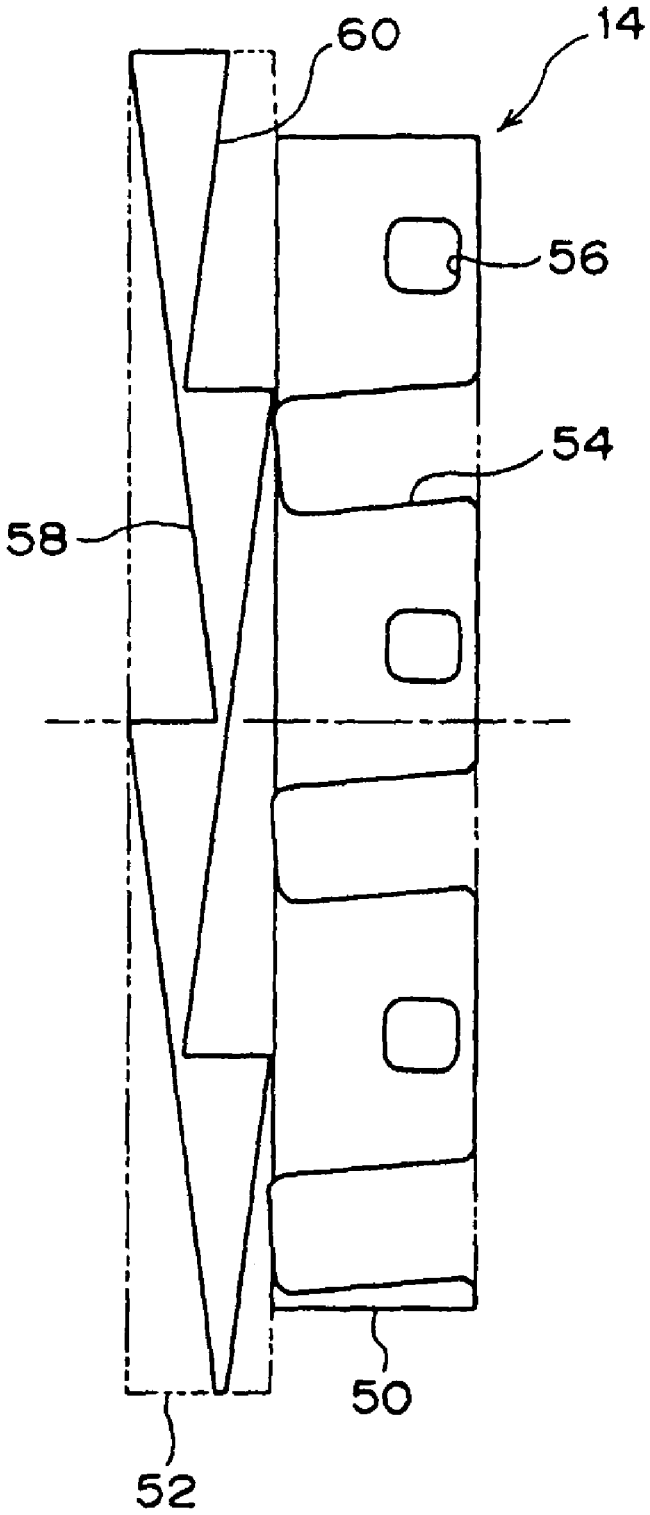
FIG. 12 is a development view of the intermediate member on its outer peripheral side.
Figure 13:
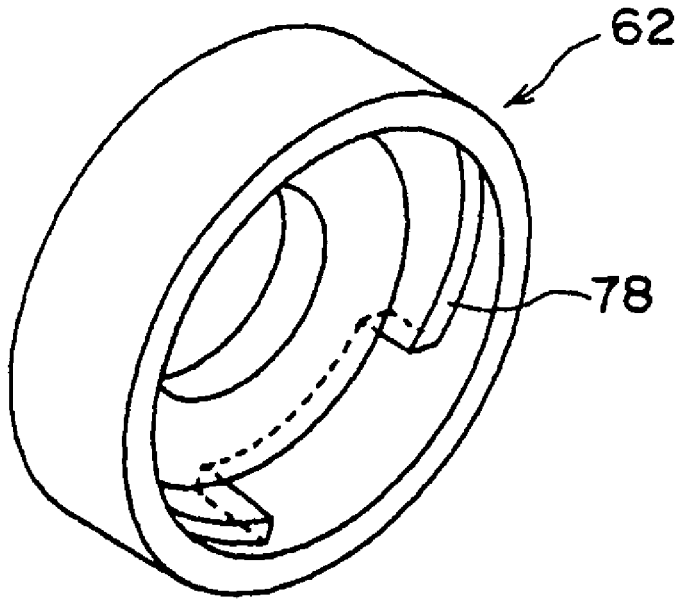
FIG. 13 is a perspective view of a rotational drum.
Figure 14:
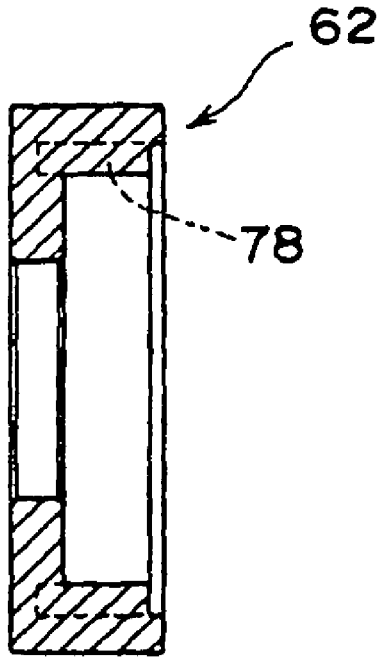
FIG. 14 is a sectional view of the rotational drum.
Figure 15:
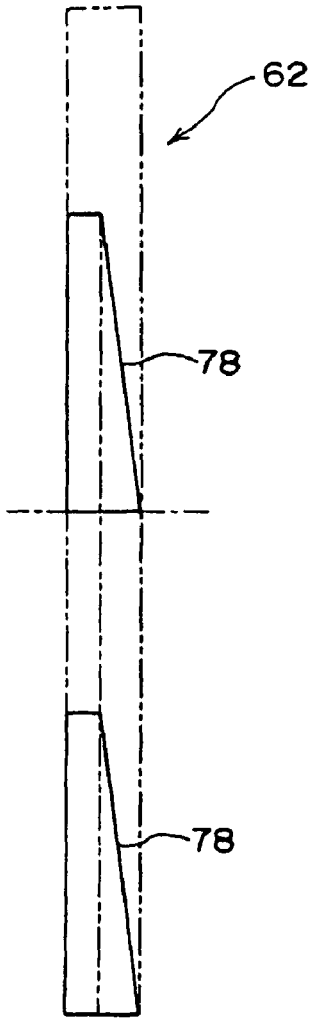
FIG. 15 is a development view of the rotational drum on its inner peripheral side.
Figure 16:
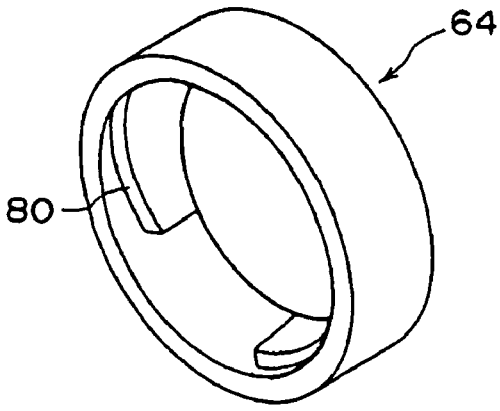
FIG. 16 is a perspective view of another rotational drum.
Figure 17:
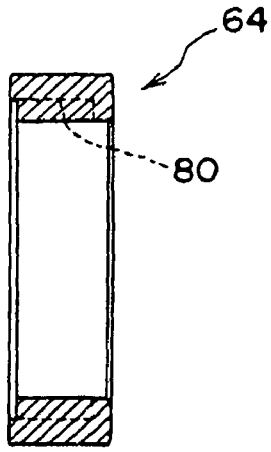
FIG. 17 is a sectional view of the other rotational drum.
Figure 18:
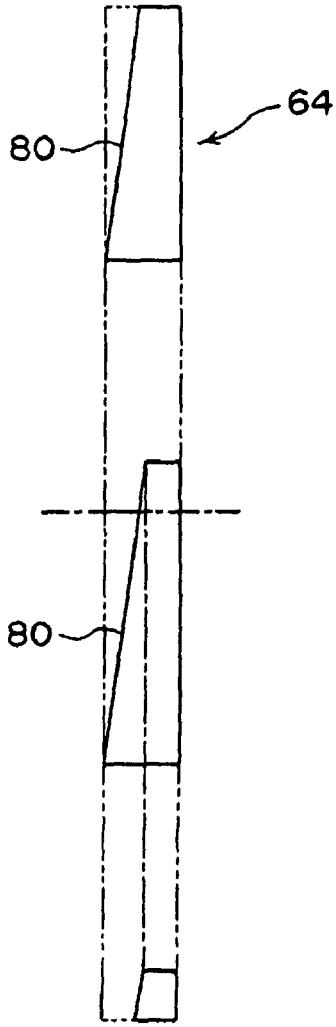
FIG. 18 is a development view of the other rotational drum on its inner peripheral side.
Figure 19:
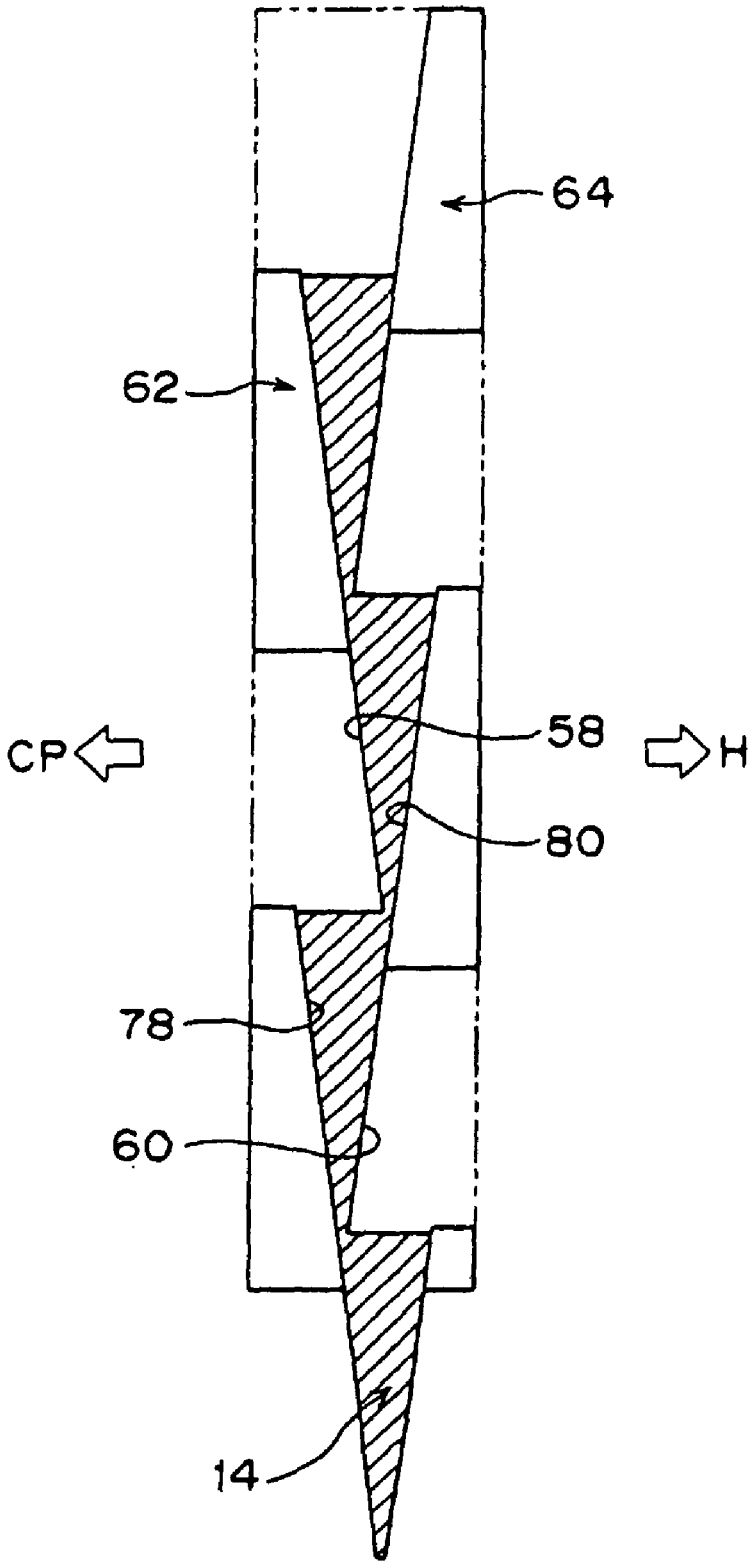
FIG. 19 is a development view for explaining the relationship between the intermediate member and a pair of rotational drums.
Figure 20:
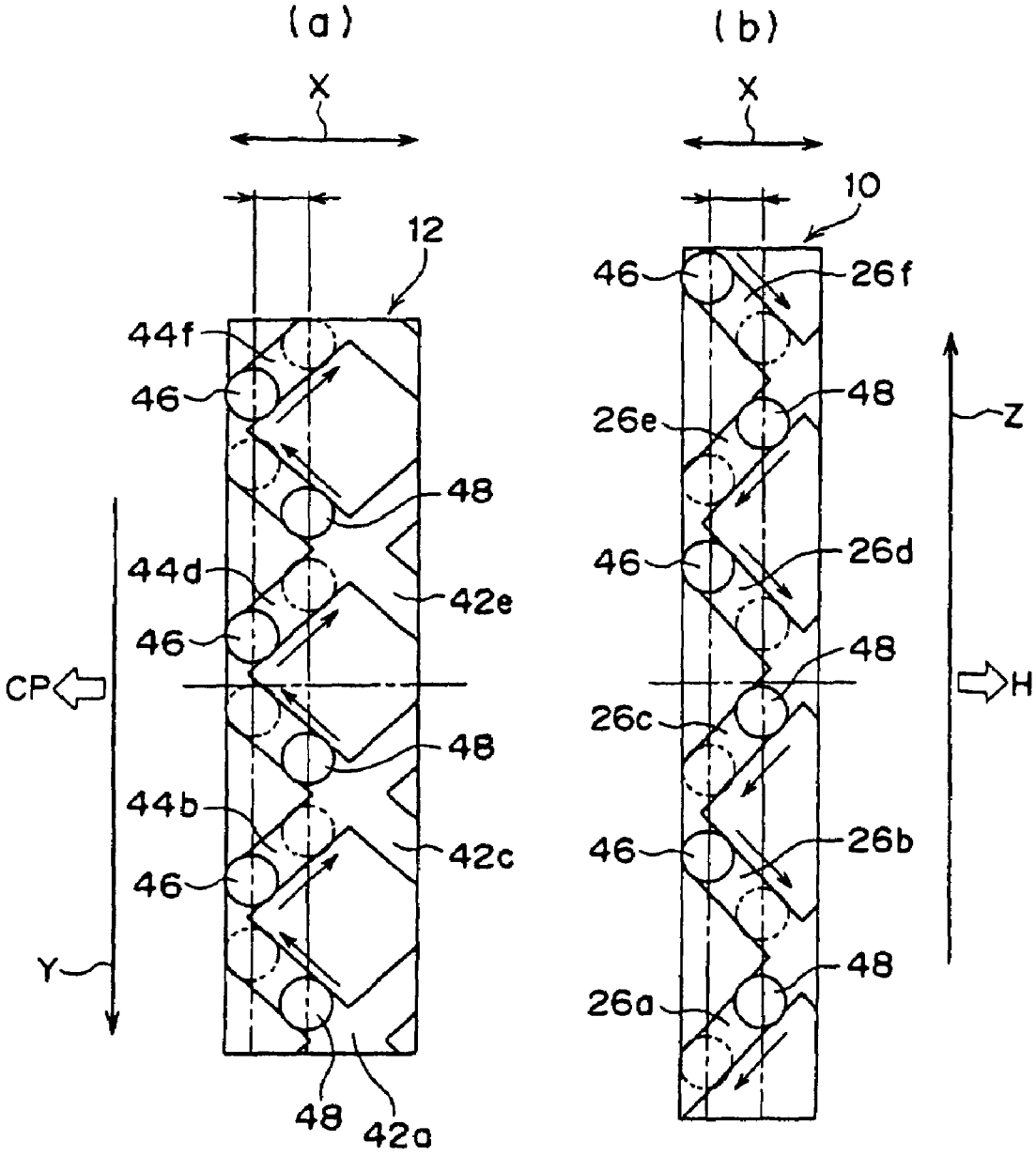
FIG. 20A is a development view for explaining the relationship between six balls and the inner cylinder part.
FIG. 20B is a development view for explaining the relationship between six balls and the outer cylinder part.
Figure 21:
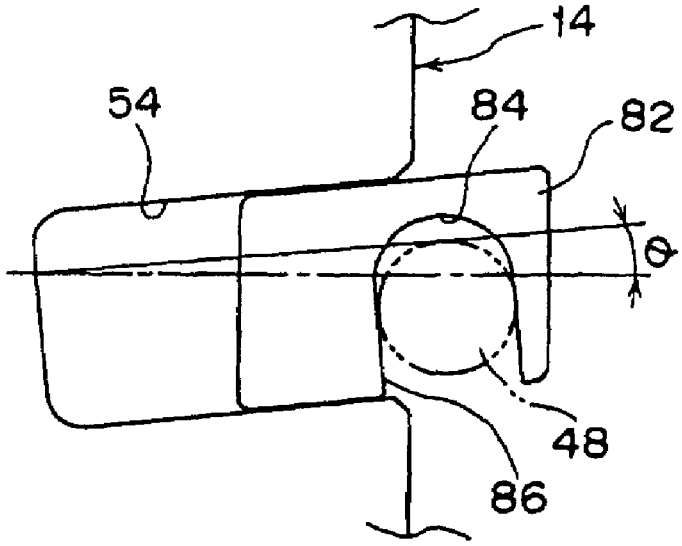
FIG. 21 is an enlarged view of a main part for explaining the relationship between a piece and the intermediate member.
Figure 22:
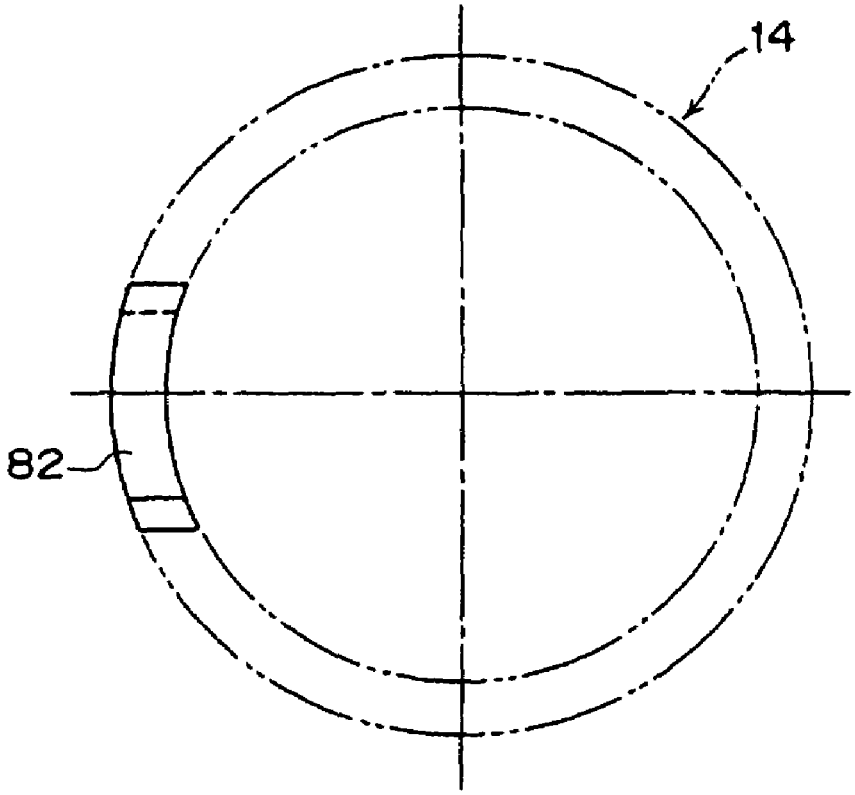
FIG. 22 is an enlarged rear view of the main part for explaining the relationship between the piece and the intermediate member.
Figure 23:
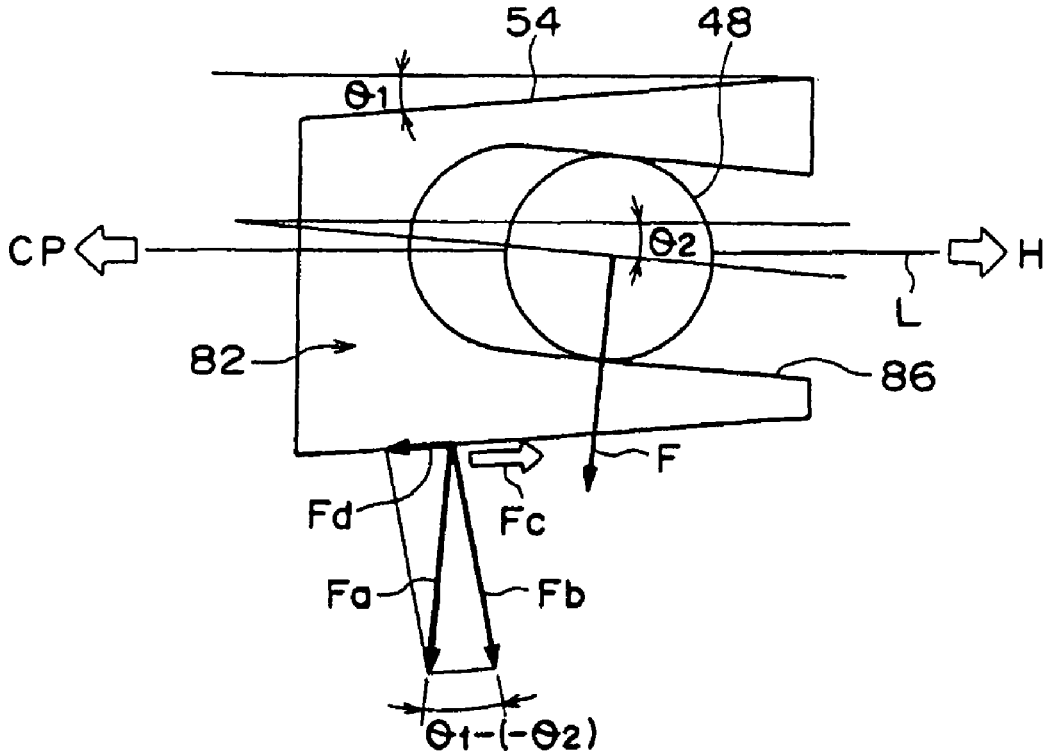
FIG. 23 is a schematic view for explaining the relationship between the ball and the piece when advance or retard control is not performed.
Figure 24:
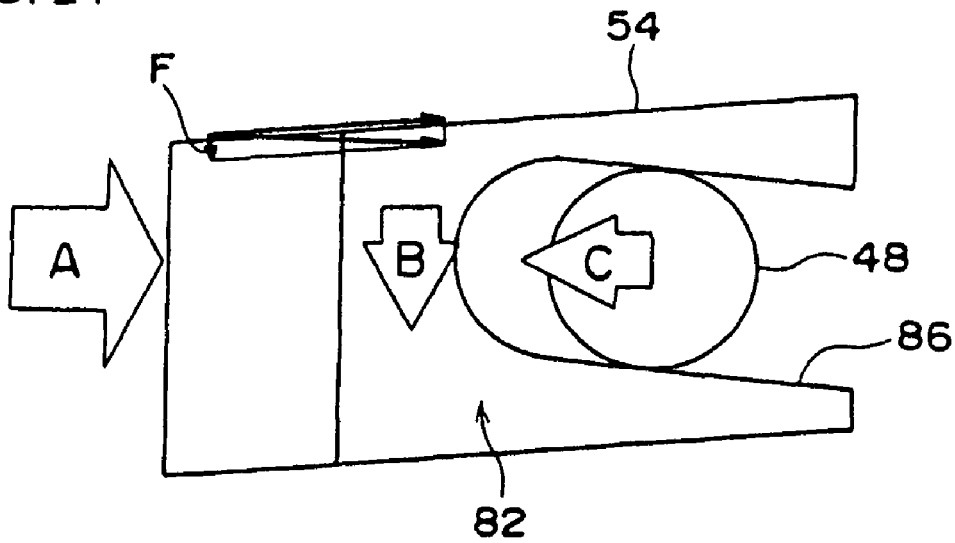
FIG. 24 is a schematic view for explaining the relationship between the ball and the piece when advance or retard control is performed.
Figure 25:
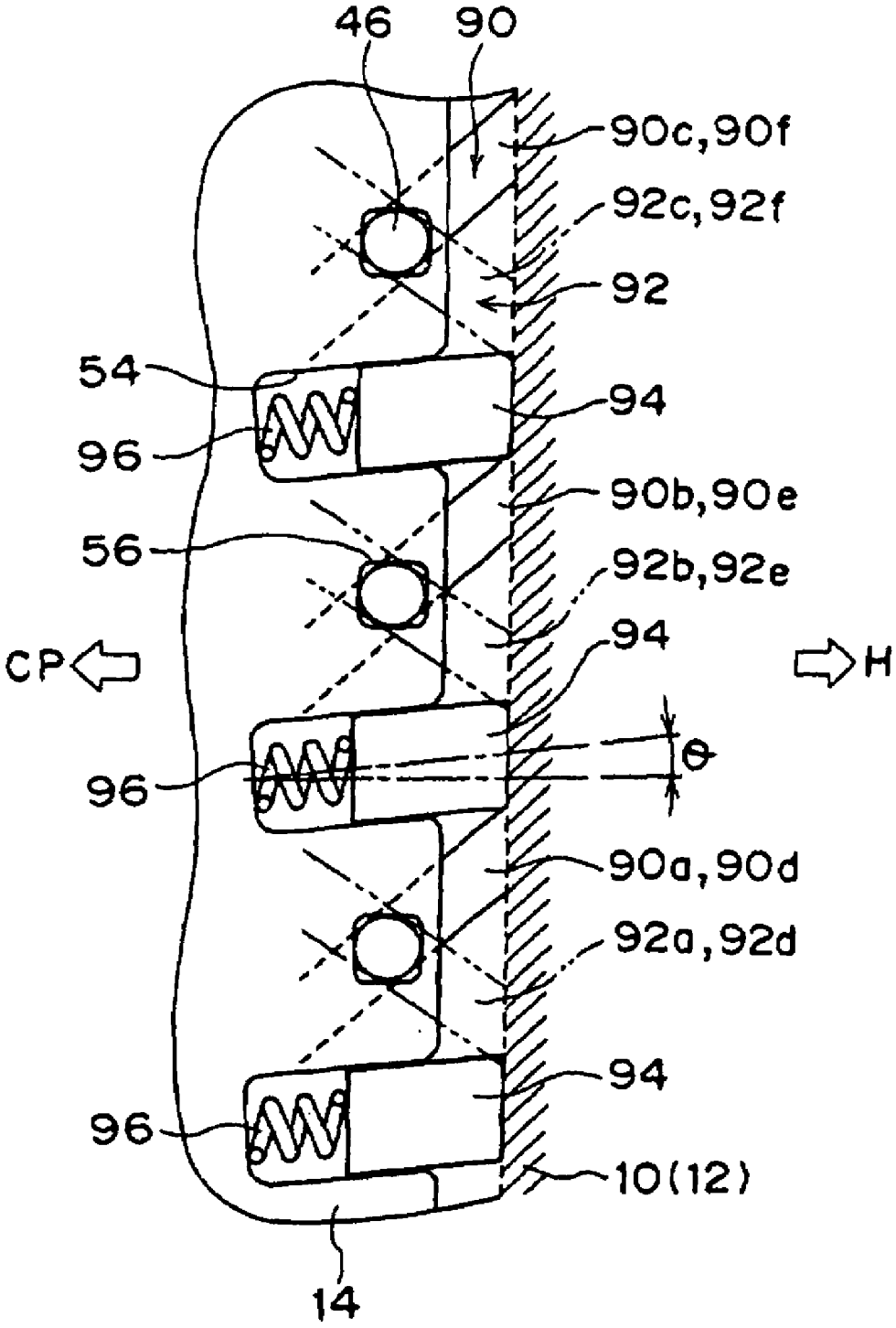
FIG. 25 is a development view of a main part of a phase adjusting mechanism, showing a second embodiment of the present invention.
Figure 26:
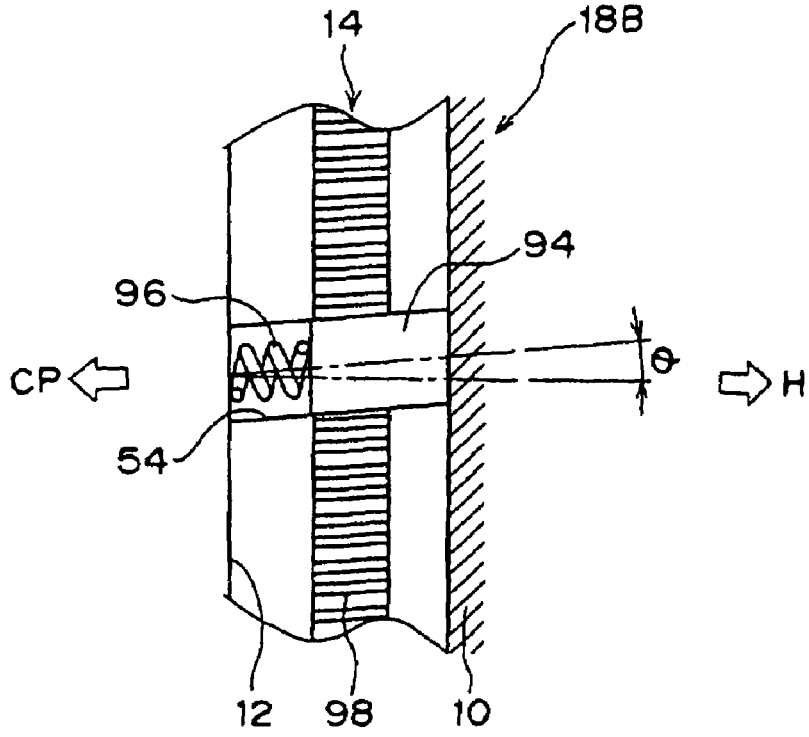
FIG. 26 is a development view of a main part of a phase adjusting mechanism, showing a third embodiment of the present invention.
Figure 27:
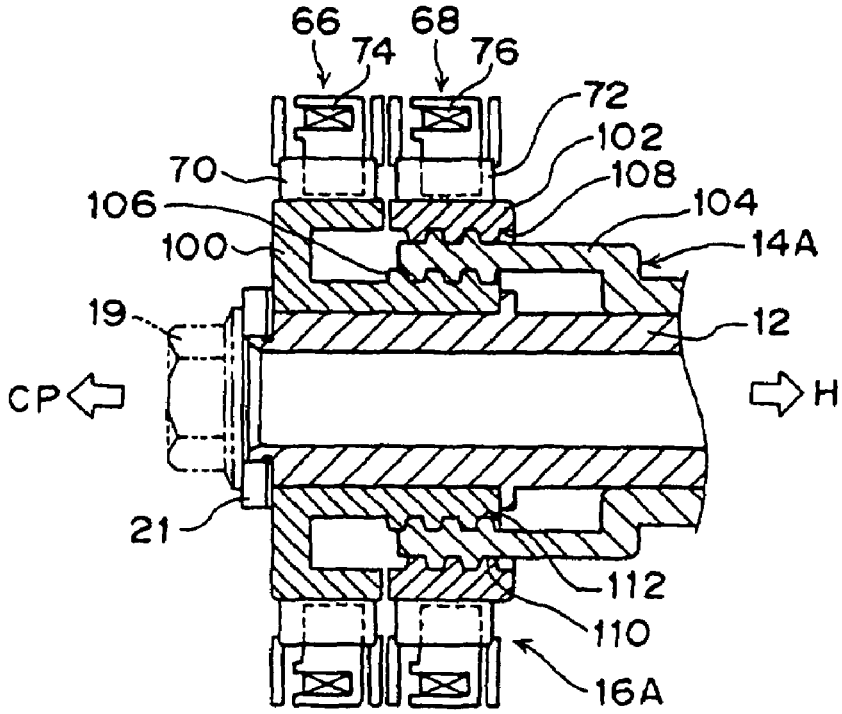
FIG. 27 is a sectional view of a position control mechanism, showing a fourth embodiment of the present invention.
Figure 28:
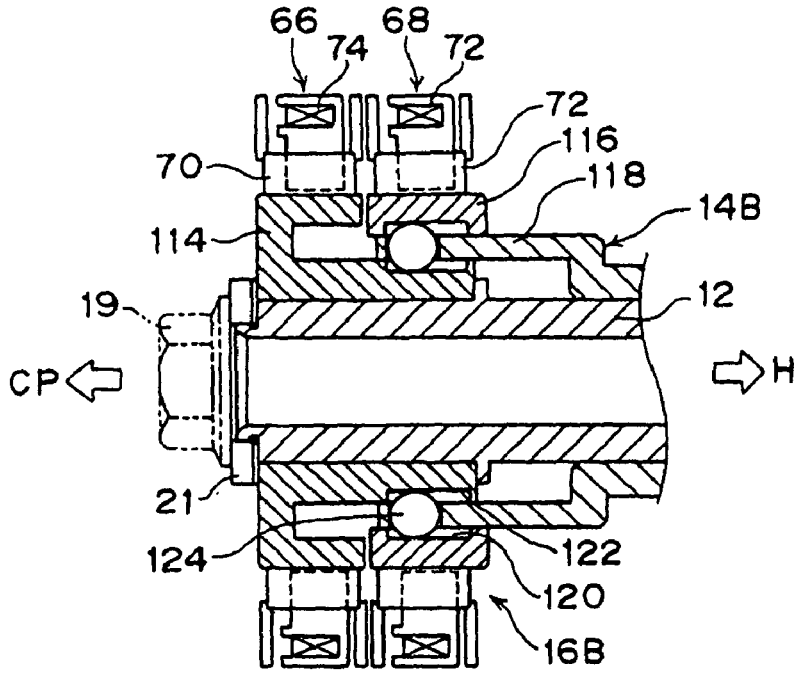
FIG. 28 is a sectional view of a position control mechanism, showing a fifth embodiment of the present invention.
Figure 29:
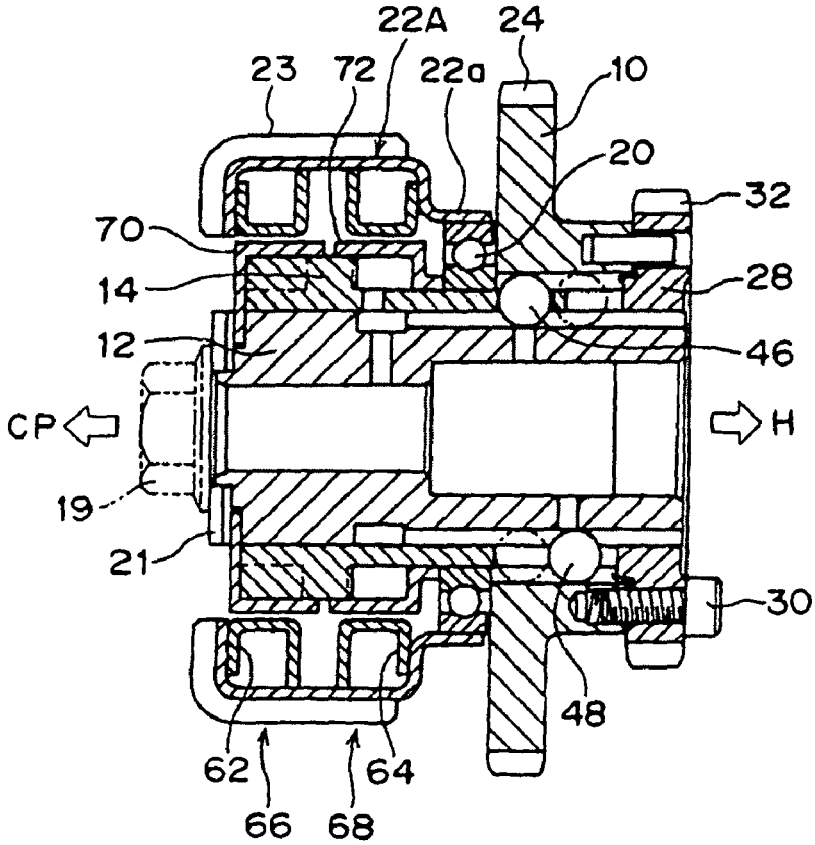
FIG. 29 is a longitudinal sectional view of a valve control apparatus for an engine, showing a sixth embodiment of the present invention.
Figure 30:
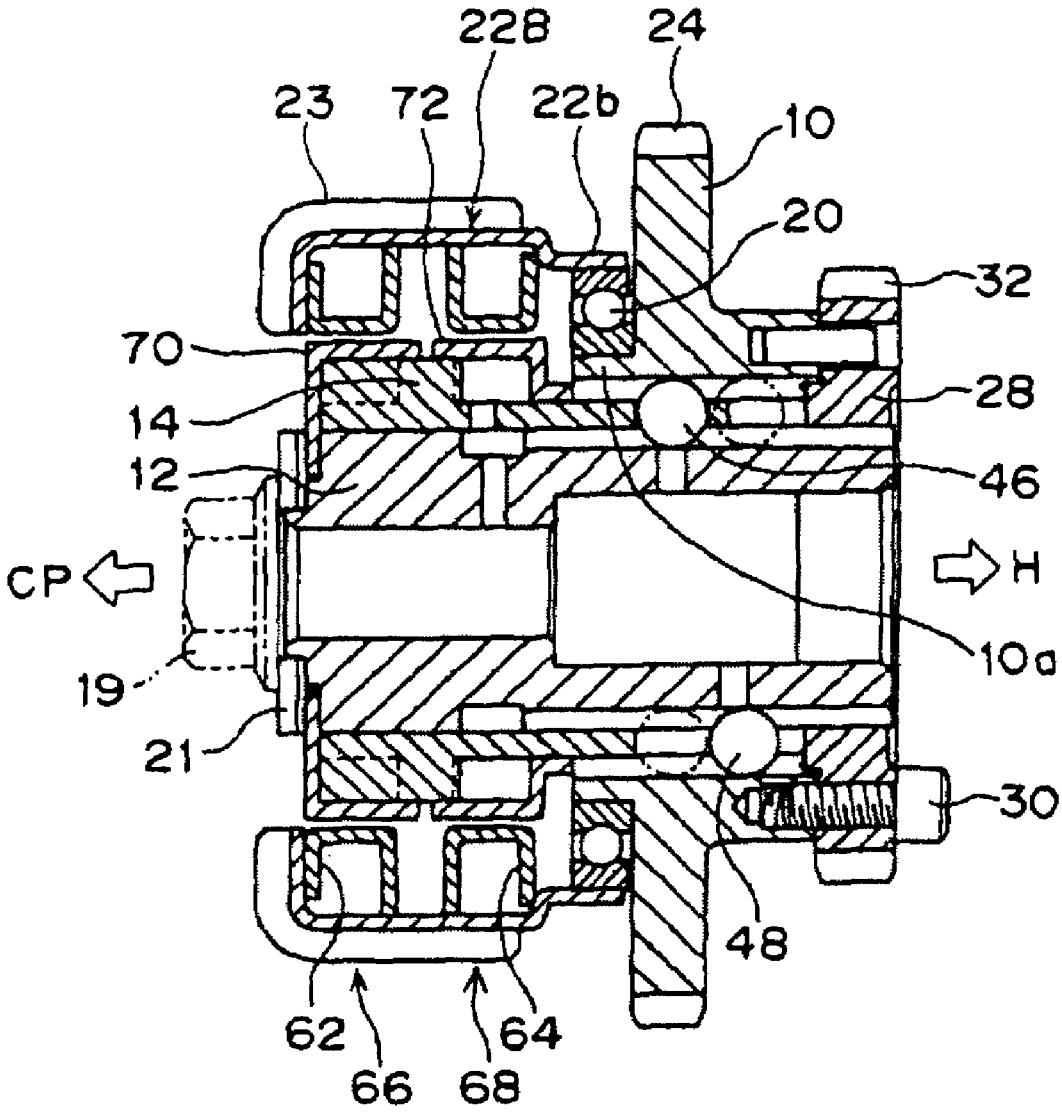
FIG. 30 is a longitudinal sectional view of a valve control apparatus for an engine, showing a seventh embodiment of the present invention.

10 Outer cylinder part
12 Inner cylinder part
14, 14A, 14B Intermediate member
16, 16A, 16B Position control mechanism
18, 18A, 18B Phase adjusting mechanism
26 Lead groove
28 Small-diameter outer cylinder part
34, 36 Large-diameter part
42, 44 Lead groove
46, 48 Ball
50 Small-diameter part
52 Large-diameter part
54 Guide groove
56 Fixing hole
58, 60 Ramp
62, 64, 100, 102, 114, 116 Rotational drum
66, 68 Electromagnetic clutch
70, 72 Braking plate
74, 76 Solenoid
78, 80 Ramp
82, 94 Piece
84 Groove
86 Straight-line part

The invention claimed is:

1. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the phase adjusting mechanism includes:

a first lead groove formed on the inner periphery of the outer cylinder part in a direction intersecting with an axial center of the outer cylinder part;

a second lead groove formed in an area of the outer periphery of the inner cylinder part, the area facing the first lead groove, the second lead groove extending in a direction intersecting with an axial center of the inner cylinder part and intersecting with the first lead groove; and a plurality of sliding bodies or rolling bodies that are divided into two groups and that are slidably or rollably inserted in sliding passages or rolling passages on the assumption that the first lead groove and the second lead groove are used as the sliding passages or as the rolling passages;

wherein the sliding bodies or the rolling bodies belonging to one of the two groups are slidably or rollably placed on the intermediate member, whereas the sliding bodies or the rolling bodies belonging to the other one of the two groups are slidably or rollably placed on a piece, wherein the piece is slidably or rollably inserted in a guide groove formed on a surface of the intermediate member, the surface facing the sliding passage or the rolling passage, wherein an intersection angle between the piece and the guide groove is set to exceed 0 degrees below a friction angle, and wherein the sliding bodies or the rolling bodies belonging to the one of the two groups and the sliding bodies or the rolling bodies belonging to the other one of the two groups move in mutually opposite directions along the sliding passages or the rolling passages in response to a movement of the intermediate member.

2. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the phase adjusting mechanism includes:

a first lead groove group whose lead grooves are formed on the inner periphery of the outer cylinder part in a direction intersecting with the axial center of the outer cylinder part and are formed in parallel with each other;

a second lead groove group whose lead grooves are formed in an area of the outer periphery of the inner cylinder part, the area facing the first lead groove group, the second lead groove group extending in a direction intersecting with the axial center of the inner cylinder part and opposite to the direction of the first lead groove group, the lead grooves of the second lead groove group being formed in parallel with each other;

a plurality of sliding bodies or rolling bodies slidably or rollably inserted in sliding passages or rolling passages on the assumption that the first lead groove group and the second lead groove group are used as the sliding passages or as the rolling passages; and a piece slidably or rollably inserted in a guide groove formed on a surface of the intermediate member, the surface facing the sliding passage or the rolling passage;

wherein the sliding bodies or the rolling bodies are slidably or rollably placed on the intermediate member, wherein the piece receives an elastic force, and is urged in a direction receding from the intermediate member, wherein a movement of the piece caused by the elastic force is restricted by contact with the outer cylinder part or with the inner cylinder part, and wherein an intersection angle between the piece and the guide groove is set to exceed 0 degrees below a friction angle.

3. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the phase adjusting mechanism includes a piece and a spring arranged mutually in series and inserted between the outer cylinder part and the inner cylinder part, wherein either the intermediate member and the outer cylinder part or the intermediate member and the inner cylinder part are engaged with each other with a helical spline, wherein the piece is slidably inserted in a guide groove formed on the intermediate member, and is urged in a direction receding from the intermediate member by receiving an elastic force from the spring installed in the guide groove, wherein a movement of the piece caused by the elastic force of the spring is restricted by contact with the outer cylinder part or with the inner cylinder part, and wherein an intersection angle between the piece and the guide groove is set to exceed 0 degrees below a friction angle.

4. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the position control mechanism includes:

a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force;

wherein each of the rotary drums is provided with a sliding ramp used for sliding, the sliding ramp extending in a circumferential direction of the rotary drum on an inner peripheral side of the rotary drum, and wherein each ramp is engaged with one of a pair of positioning ramps used for positioning, the positioning ramp extending in a circumferential direction of the intermediate member on an outer peripheral side of the intermediate member.

5. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the position control mechanism includes:

a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force;

wherein a flange part of the intermediate member is inserted between the one of the rotary drums and the other one of the rotary drums, wherein a surface of each rotary drum facing the flange part of the intermediate member is provided with a forward-lead screw part or a backward-lead screw part that guides the intermediate member in the axial direction of the inner cylinder part, wherein the flange part of the intermediate member has a forward-lead screw part or a backward-lead screw part, and wherein the forward-lead screw part of the rotary drum and the forward-lead screw part of the intermediate member are kept in a state of being engaged with each other, or the backward-lead screw part of the rotary drum and the backward-lead screw part of the intermediate member are kept in a state of being engaged with each other.

6. A valve control apparatus for an engine, comprising:

an outer cylinder part to which a driving force of a crankshaft of the engine is transmitted;

an inner cylinder part that is relatively rotatably disposed on an inner peripheral side of the outer cylinder part and that is coaxially connected to a camshaft by which an intake valve or an exhaust valve of the engine is opened and closed;

an intermediate member disposed on an outer periphery of the inner cylinder part so as to be movable in an axial direction of the inner cylinder part;

a position control mechanism that controls a position in an axial direction of the intermediate member in accordance with an operational state of the engine; and a phase adjusting mechanism that variably adjusts a phase between the outer cylinder part and the camshaft in accordance with the position in the axial direction of the intermediate member;

wherein the phase adjusting mechanism blocks torque input from the outer cylinder part or from the camshaft from being transmitted when the torque is input therefrom, and converts a displacement in the axial direction from the intermediate member into a displacement in a circumferential direction thereof in response to the displacement in the axial direction from the intermediate member, and gives displacements in the circumferential direction to the outer cylinder part and to the inner cylinder part, respectively, the displacements in the circumferential direction being different in magnitude depending on the position in the axial direction of the intermediate member and being mutually opposite in direction, and wherein the position control mechanism includes:

a plurality of rotary drums disposed around the inner cylinder part so as to be rotated together with the inner cylinder part; and an electromagnetic clutch, the electromagnetic clutch giving a braking force to one of the rotary drums and slowing down the rotation thereof together with the inner cylinder part during advance control based on an electromagnetic force, the electromagnetic clutch giving a braking force to the other one of the rotary drums and slowing down the rotation thereof together with the inner cylinder part during retard control based on an electromagnetic force;

wherein a flange part of the intermediate member is inserted between the one of the rotary drums and the other one of the rotary drums, wherein a surface of each rotary drum facing the flange part of the intermediate member is provided with a forward-lead groove or a backward-lead groove that guides the intermediate member in the axial direction of the inner cylinder part, and wherein the flange part of the intermediate member has a sliding body or a rolling body that is placed slidably or rollably and that uses the forward-lead groove or the backward-lead groove as a sliding passage or a rolling passage.

* * * * *